US007808435B2

(12) United States Patent
Nagumo et al.

(10) Patent No.: US 7,808,435 B2
(45) Date of Patent: Oct. 5, 2010

(54) ANTENNA STRUCTURE AND WIRELESS COMMUNICATION APPARATUS INCLUDING SAME

(75) Inventors: Shoji Nagumo, Sagamihara (JP); Kazuyuki Furuya, Yokohama (JP); Mie Shimizu, Yokohama (JP); Hirotaka Fujii, Sagamihara (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 81 days.

(21) Appl. No.: 12/188,550

(22) Filed: Aug. 8, 2008

(65) Prior Publication Data

US 2009/0015497 A1 Jan. 15, 2009

Related U.S. Application Data

(63) Continuation of application No. PCT/JP2006/323818, filed on Nov. 29, 2006.

(30) Foreign Application Priority Data

Feb. 14, 2006 (JP) ..... 2006-036830

(51) Int. Cl.
*H01Q 1/38* (2006.01)

(52) U.S. Cl. ..... 343/700 MS; 343/702

(58) Field of Classification Search ..... 343/700 MS, 343/702, 750

See application file for complete search history.

(56) References Cited

U.S. PATENT DOCUMENTS

| | | | | |
|---|---|---|---|---|
| 3,503,556 | A | 3/1970 | Moulton | |
| 3,528,737 | A | 9/1970 | Denner | |
| 3,658,639 | A | 4/1972 | Wirth | |
| 6,300,909 | B1 | 10/2001 | Tsubaki et al. | |
| 6,597,317 | B2 | 7/2003 | Talvitie | |
| 6,693,594 | B2 * | 2/2004 | Pankinaho et al. | 343/700 MS |
| 7,136,020 | B2 | 11/2006 | Yamaki | |
| 2001/0048390 | A1 | 12/2001 | Nagumo et al. | |

(Continued)

FOREIGN PATENT DOCUMENTS

| | | |
|---|---|---|
| EP | 1122812 | 8/2001 |

(Continued)

OTHER PUBLICATIONS

International Search Report (Apr. 2005).

(Continued)

*Primary Examiner*—Tan Ho
(74) *Attorney, Agent, or Firm*—Keating & Bennett, LLP

(57) ABSTRACT

In an antenna structure in which a base is mounted in a ground region on a circuit board, the base having formed thereon a driven radiating electrode and a parasitic radiating electrode, the parasitic radiating electrode causing multiple resonance at least in a harmonic resonant frequency band of the driven radiating electrode, capacitance loading means for loading a capacitance to a harmonic-mode zero voltage region of the driven radiating electrode is provided. The capacitance loading means is electrically connected to a ground electrode in the ground region on the circuit board via a grounding conduction path and switching means. By switching the switching means ON/OFF, capacitance loading by the capacitance loading means to the harmonic-mode zero voltage region of the driven radiating electrode is switched ON/OFF to switch a base resonant frequency in a base resonant frequency band of the driven radiating electrode.

20 Claims, 11 Drawing Sheets

U.S. PATENT DOCUMENTS

2002/0030626 A1 3/2002 Nagumo et al.

FOREIGN PATENT DOCUMENTS

| | | |
|---|---|---|
| EP | 1 146 590 | 10/2001 |
| JP | 10-224142 | 8/1998 |
| JP | 11-136025 | 5/1999 |
| JP | 2001-168634 | 6/2001 |
| JP | 2001-217643 | 8/2001 |
| JP | 2002-43833 | 2/2002 |
| JP | 2002-185239 | 6/2002 |
| JP | 3503556 | 12/2003 |
| JP | 3528737 | 3/2004 |
| JP | 2004-274223 | 9/2004 |
| JP | 2004-312364 | 11/2004 |
| JP | 3658639 | 3/2005 |
| JP | 2005-150937 | 6/2005 |
| WO | 2004/109850 | 12/2004 |

OTHER PUBLICATIONS

Written Opinion with English Language Translation.
Examination Report in the corresponding Japanese Application with English Language Translation (Apr. 2005).

* cited by examiner

ANTENNA STRUCTURE AND WIRELESS COMMUNICATION APPARATUS INCLUDING SAME

CROSS-REFERENCE TO RELATED APPLICATIONS

This is a continuation under 35 U.S.C. §111(a) of PCT/JP2006/323818 filed Nov. 29, 2006, and claims priority of JP2006-036830 filed Feb. 14, 2006, both incorporated by reference.

BACKGROUND

1. Technical Field

The present invention relates to antenna structures provided in wireless communication apparatuses, such as cellular phones, and to wireless communication apparatuses including the antenna structures.

2. Background Art

FIG. 13*a* is a schematic perspective view showing an example of an antenna structure (e.g., refer to Patent Document 1). The antenna structure 40 includes a dielectric base 41 having a rectangular parallelepiped shape, and a ground electrode 42 is formed on the bottom surface of the dielectric base 41. Furthermore, on the top surface of the dielectric base 41, a driven radiating or feeding electrode 43 and a parasitic radiating or non-feeding electrode 44 are provided adjacent to each other, separated by a slit s1. On a side surface of the dielectric base 41, a connecting electrode 45 and a connecting electrode 46, spaced from each other. The connecting electrode 45 serves to electrically connect the driven radiating electrode 43 and the ground electrode 42. The connecting electrode 46 serves to electrically connect the parasitic radiating electrode 44 and the ground electrode 42.

On a side surface of the dielectric base 41 opposing the surface on which the connecting electrodes 45 and 46 are formed, a feeding electrode 47 for the driven radiating electrode is formed, and a frequency controlling electrode 48 is also formed. An upper end of the feeding electrode 47 is provided with a space from the driven radiating electrode 43 so as to form a capacitor with the driven radiating electrode 43. A lower end of the feeding electrode 47 is formed so as to extend to the bottom surface of the dielectric base 41. The lower end of the feeding electrode 47 is provided with a space from the ground electrode 42, and the lower end of the feeding electrode 47 is electrically connected to, for example, a high-frequency circuit 50 for wireless communication provided in a wireless communication apparatus. An upper end of the frequency controlling electrode 48 is provided with a space from the driven radiating electrode 43 and with a space from the parasitic radiating electrode 44 so as to form capacitors C1 and C2 with the driven radiating electrode 43 and the parasitic radiating electrode 44, respectively. A lower end of the frequency controlling electrode is formed so as to extend to the bottom surface of the dielectric base 41. The lower end of the frequency controlling electrode 48 is provided with a space from the ground electrode 42. Furthermore, the lower end of the frequency controlling electrode 48 is grounded via switching means 51, for example, to the ground of a wireless communication apparatus.

In the antenna structure 40 shown in FIG. 13*a*, for example, when a signal to send has been supplied from the high-frequency circuit 50 for wireless communication to the feeding electrode 47, through capacitive coupling between the feeding electrode and the driven radiating electrode 43, the signal to send is transmitted from the feeding electrode 47 to the driven radiating electrode 43, whereby the driven radiating electrode 43 resonates according to the signal to send. Furthermore, the signal to send is also transmitted to the parasitic radiating electrode 44 through electromagnetic coupling between the driven radiating electrode 43 and the parasitic radiating electrode 44, whereby the parasitic radiating electrode also resonates. In the antenna structure 40, the space s1 between the driven radiating electrode 43 and the parasitic radiating electrode 44 and other factors are designed so that the resonance of the driven radiating electrode 43 and the resonance of the parasitic radiating electrode 44 cause multiple resonance.

The resonant operation (multiple resonant operation) of the driven radiating electrode 43 and the parasitic radiating electrode 44 is an antenna operation that sends the signal to send wirelessly to the outside. Furthermore, when a signal from the outside has reached the driven radiating electrode 43 and the parasitic radiating electrode 44, the driven radiating electrode 43 and the parasitic radiating electrode 44 resonate according to the received signal, whereby the received signal is transmitted from the driven radiating electrode 43 to the feeding electrode 47 and further to the high-frequency circuit 50 for wireless communication. The resonant operation of the driven radiating electrode 43 and the parasitic radiating electrode 44 according to the wireless communication signal from the outside, described above, is an antenna operation for reception.

In the antenna structure 40, the frequency controlling electrode 48 forms capacitors individually with the driven radiating electrode 43 and the parasitic radiating electrode 44, and the frequency controlling electrode 48 is grounded via the switching means 51. With this configuration, in the antenna structure 40, it is possible to switch the resonant frequency bands of the driven radiating electrode 43 and the parasitic radiating electrode 44 as described below. For example, let it be supposed that when the switching means 51 is OFF so that the frequency controlling electrode 48 is not grounded, for example, the driven radiating electrode 43 has a resonant frequency band indicated by a dotted line A having a resonant frequency f1 shown in FIG. 13*b*, the parasitic radiating electrode 44 has a resonant frequency band indicated by a chain line B having a resonant frequency f2 shown in FIG. 13*b*, and the driven radiating electrode 43 and the parasitic radiating electrode 44 cause multiple resonance as indicated by a solid line a in FIG. 13*b*.

On the other hand, when the switching means 51 becomes ON so that the frequency controlling electrode 48 is grounded, capacitors are formed with the ground between the driven radiating electrode 43 and the frequency controlling electrode 48 and the parasitic radiating electrode 44 and the frequency controlling electrode 48. Thus, a capacitance with the ground is loaded to the driven radiating electrode 43, and also a capacitance with the ground is loaded to the parasitic radiating electrode 44.

FIG. 13*c* shows an equivalent circuit of the driven radiating electrode 43 by solid lines. Since the resonant operation of the driven radiating electrode 43 is an LC resonance of an inductance component L and a capacitance component C of the driven radiating electrode 43, shown in FIG. 13*c*, the resonant frequency F of the driven radiating electrode 43 is proportional to $1/\sqrt{(LC)}$ ($F \propto 1/\sqrt{(LC)}$). This similarly applies to the resonant frequency of the parasitic radiating electrode 44. Thus, when the switching means 51 becomes ON so that capacitances with the ground are loaded to the driven radiating electrode 43 and the parasitic radiating electrode 44 by the frequency loading electrode 48, the capacitance components of the driven radiating electrode 43 and the parasitic radiating electrode 44 increase, so that the resonant frequencies of the driven radiating electrode 43 and the parasitic radiating electrode 44 become lower. Thus, when the switching means 51 is switched from OFF to ON, for example, the resonant frequency of the driven radiating electrode 43 is switched from the frequency f1 to a frequency f1', and for example, the resonant frequency of the parasitic radiating electrode 44 is switched from the frequency f2 to a frequency f2'. Thus, the multiple resonance by the driven radiating electrode 43 and the parasitic radiating electrode 44 is switched from the state indicated by the solid line α the state indicated by a solid line β in FIG. 13*b*.

In this antenna structure, when the switching means 51 is OFF, the frequency bands for wireless communication by antenna operations of the driven radiating electrode 43 and the parasitic radiating electrode 44 fall in a frequency range of, for example, a frequency fm to a frequency fn shown in FIG. 13*b*. On the other hand, when the switching means 51 is ON, the frequency bands for wireless communication by antenna operations of the driven radiating electrode 43 and the parasitic radiating electrode 44 are switched, for example, to a frequency range from a frequency fm' to a frequency fn' shown in FIG. 13*b*.

Thus, for example, in a case where the configuration for frequency switching described above is provided, the antenna structure 40 can support wireless communication in the frequency range of, for example, the frequency fm' to the frequency fn'. That is, it is possible to increase the frequency band of the antenna structure 40. This is in contrast to a case where no configuration for frequency switching by the frequency controlling electrode 48 is provided, in which the frequency bands for wireless communication by antenna operations of the driven radiating electrode 43 and the parasitic radiating electrode 44 fall only in the frequency range of, for example, the frequency fm to the frequency fn.

Patent Document 1: Japanese Unexamined Patent Application Publication No. 2001-168634

Patent Document 2: Japanese Unexamined Patent Application Publication No. 2005-150937

SUMMARY

Recently, there exists a demand for multi-band antennas that are compatible with a plurality of wireless communication systems that use frequency bands different from each other. Even with the antenna structure 40 having an increased bandwidth as described above, it has been difficult to satisfy the demand for multiple bands due to the insufficiency of frequency bands that can be used for wireless communication.

The disclosed antenna structure solves the problems described above by the following configurations. One configuration is as follows:

An antenna structure in which a base is mounted in a ground region on a circuit board, which may have a wireless communication circuit formed thereon, the base has provided thereon a driven radiating electrode that is electrically connected to the wireless communication circuit and that performs antenna operations in a plurality of resonant frequency bands different from each other, a parasitic radiating electrode electromagnetically coupled to the driven radiating electrode is provided with a space from the driven radiating electrode, the driven radiating electrode is a radiating electrode having one end that serves as a feeding end electrically connected to the wireless communication circuit and the other end that serves as an open end, the driven radiating electrode has such a form that the feeding end and the open end thereof are provided adjacent to each other via a space so that a loop-shaped current path is formed between the feeding end and the open end, the parasitic radiating electrode performs an antenna operation with the driven radiating electrode through electromagnetic coupling with the driven radiating electrode so as to cause multiple resonance at least in a harmonic resonant frequency band, the harmonic resonant frequency band being higher than a base resonant frequency band, the base resonant frequency band being lowest among the plurality of resonant frequency bands of the driven radiating electrode, the antenna structure comprising:

capacitance loading means for loading a capacitance to a harmonic-mode zero-voltage region of the driven radiating electrode, the harmonic-mode zero-voltage region being a region where a voltage becomes zero or nearly zero in a harmonic mode, the harmonic mode being an antenna operation mode in the harmonic resonant frequency band;

a grounding conduction path that electrically connects a ground electrode with the capacitance loading means, the ground electrode being formed in the ground region on the circuit board; and switching means, provided in the grounding conduction path, for switching conduction ON/OFF between the capacitance loading means and the ground electrode on the circuit board to control switching between ON and OFF of capacitance loading by the capacitance loading means to the harmonic-mode zero-voltage region of the driven radiating electrode, thereby switching a base resonant frequency in the base resonant frequency band of the driven radiating electrode.

Another configuration according to the present invention is as follows:

An antenna structure in which a base is mounted in a ground region on a circuit board, which may have a wireless communication circuit formed thereon, the base has provided thereon a driven radiating electrode that is electrically connected to the wireless communication circuit and that performs antenna operations in a plurality of resonant frequency bands different from each other, a parasitic radiating electrode electromagnetically coupled to the driven radiating electrode is provided with a space from the driven radiating electrode, the driven radiating electrode is a radiating electrode having one end that serves as a feeding end electrically connected to the wireless communication circuit and the other end that serves as an open end, the driven radiating electrode has such a form that the feeding end and the open end thereof are provided adjacent to each other via a space so that a loop-shaped current path is formed between the feeding end and the open end, the parasitic radiating electrode performs an antenna operation with the driven radiating electrode through electromagnetic coupling with the driven radiating electrode so as to cause multiple resonance at least in a harmonic resonant frequency band, the harmonic resonant frequency band being higher than a base resonant frequency band, the base resonant frequency band being lowest among the plurality of resonant frequency bands of the driven radiating electrode, the antenna structure comprising:

wherein option capacitance loading means for loading a capacitance to a harmonic-mode zero-voltage region of the driven radiating electrode is formed on the base, the harmonic-mode zero-voltage region being a region where a voltage becomes zero or nearly zero in a harmonic mode, the harmonic mode being an antenna operation mode in the harmonic resonant frequency band, and wherein when the option capacitance loading means loads a capacitance to the harmonic-mode zero-voltage region of the driven radiating electrode, a grounding conduction path is formed between the option capacitance loading means and a ground electrode formed in the ground region on the circuit board so that a capacitance is loaded to the harmonic-mode zero-voltage region of the driven radiating electrode, and when the option capacitance loading means does not load a capacitance to the harmonic-mode zero-voltage region of the driven radiating electrode, a grounding conduction path is not formed.

Furthermore, a wireless communication apparatus includes an antenna structure having a configuration characteristic as described herein.

As described herein, a base in an antenna structure has formed thereon a driven radiating electrode and a parasitic radiating electrode, and the parasitic radiating electrode is configured to cause multiple resonance with the driven radiating electrode by performing an antenna operation at least in a harmonic resonant frequency band of the driven radiating electrode. The multiple resonance by the parasitic radiating electrode in the harmonic resonant frequency band of the driven radiating electrode serves to increase the bandwidth in the harmonic resonant frequency band of the driven radiating electrode.

Furthermore, capacitance loading means for loading a capacitance to a harmonic-mode zero-voltage region of the driven radiating electrode, a grounding conduction path that electrically connects the capacitance loading means with the ground electrode on the circuit board, and switching means, provided in the grounding conduction path, for switching ON/OFF of conduction between the capacitance loading means and the ground electrode are provided. When the switching means is ON, the capacitance loading means is grounded to the ground electrode, so that the capacitance loading means loads a capacitance formed between the harmonic-mode zero-voltage region of the driven radiating electrode and the ground to the harmonic-mode zero-voltage region of the driven radiating electrode (capacitance loading is ON). Thus, compared with a state where the switching means is OFF so that the capacitance is not loaded to the driven radiating electrode (capacitance loading is OFF), when capacitance loading is ON, the electrical length of the driven radiating electrode increases in accordance with the magnitude of the loaded capacitance, whereby the base resonant frequency of the driven radiating electrode is switched to become lower. The switching of the base resonant frequency of the driven radiating electrode serves to increase the bandwidth of the base resonant frequency band of the driven radiating electrode.

A portion of the driven radiating electrode where the capacitance is loaded by the capacitance loading means is the harmonic-mode zero-voltage region of the driven radiating electrode. Thus, through ON/OFF operation of the switching means, it is possible to switch only the base resonant frequency of the driven radiating electrode without changing the harmonic resonant frequency of the driven radiating electrode. More specifically, the magnitude of a voltage in the harmonic mode in the harmonic-mode zero-voltage region of the driven radiating electrode is zero or nearly zero. Thus, for the harmonic mode, even if the switching means is turned ON, the capacitance loaded by the capacitance loading means to the harmonic-mode zero-voltage region of the driven radiating electrode may be regarded as a very small one, so that the state is substantially equivalent to that in the case where the capacitance by the capacitance loading means is not loaded to the harmonic-mode zero-voltage region of the driven radiating electrode. Thus, even if the ON/OFF operation of the switching means is switched, the harmonic resonant frequency of the driven radiating electrode does not change. In contrast, the magnitude of a voltage in the base mode in the harmonic-mode zero-voltage region of the driven radiating electrode has such a value that the state is affected by capacitance loading by the capacitance loading means. Thus, by switching the ON/OFF of capacitance loading by the ON/OFF switching operation of the switching means, the base resonant frequency of the driven radiating electrode is switched.

That is, in the configuration, since the bandwidth of the harmonic resonant frequency band of the driven radiating electrode increases by multiple resonance with the parasitic radiating electrode so that it is possible to achieve a desired frequency band, it is desired that the harmonic resonant frequency band of the driven radiating electrode does not change. Taking this into consideration, without changing the harmonic resonant frequency band of the driven radiating electrode, by switching only the base resonant frequency of the driven radiating electrode through switching of the ON/OFF of capacitance loading by the capacitance loading means, it is possible to increase the base resonant frequency band of the driven radiating electrode.

As described above, it is possible to increase the bandwidths of both the base resonant frequency band and the harmonic resonant frequency band of the driven radiating electrode. Thus, it is readily possible to provide an antenna structure that is compatible with a plurality of wireless communication systems or apparatus that use frequency bands different from each other, and to provide a wireless communication system including such an antenna structure. Particularly, the base having formed thereon the driven radiating electrode and the parasitic radiating electrode is mounted in the ground region on the circuit board. Thus, the disclosed configuration is epoch-making in that although electric fields radiated from the driven radiating electrode and the parasitic radiating electrode are drawn closer to the ground electrode on the circuit board so that basically the width of one resonant band is narrow and it is difficult to increase the frequency bandwidth, it becomes readily possible to increase the bandwidths of a plurality of frequency bands as described above.

Furthermore, the driven radiating electrode has such a form that the feeding end and the open end thereof are provided adjacent to each other with a space therebetween, and a current path between the feeding end and the open end has a loop shape. Thus, advantageously, it becomes readily possible to adjust the base resonant frequency and the harmonic resonant frequency of the driven radiating electrode. That is, since the driven radiating electrode has such a form that the feeding end and the open end thereof are provided adjacent to each other with a space and a current path between the feeding end and the open end has a loop shape, a capacitor is formed between the feeding end and the open end. This capacitor contributes more to the harmonic resonant frequency than to the base resonant frequency. Therefore, with the capacitor between the feeding end and the open end, it is possible to adjust the harmonic resonant frequency of the driven radiating electrode without substantially changing the base resonant frequency. That is, for example, by setting the electrical length between the feeding end and the open end of the driven radiating electrode to be such an electrical length that a predetermined base resonant frequency is achieved, and setting the capacitor between the feeding end and the open end to have a such a magnitude that a predetermined harmonic resonant frequency is achieved, it is possible to adjust the base resonant frequency and the harmonic resonant frequency independently of each other. Thus, it becomes readily possible to set both the base resonant frequency and the harmonic resonant frequency of the driven radiating electrode individually to predetermined frequencies.

Furthermore, since the driven radiating electrode has such a shape that the current path between the feeding end and the open end has a loop shape, it is possible to increase the electrical length of the driven radiating electrode without increasing the size of the driven radiating electrode. Thus, it is possible to reduce the size of the base, i.e., to reduce the size of the antenna structure.

Other features and advantages will become apparent from the following description of embodiments, which refers to the accompanying drawings.

DETAILED DESCRIPTION

Reference Numerals

Figure 1A:
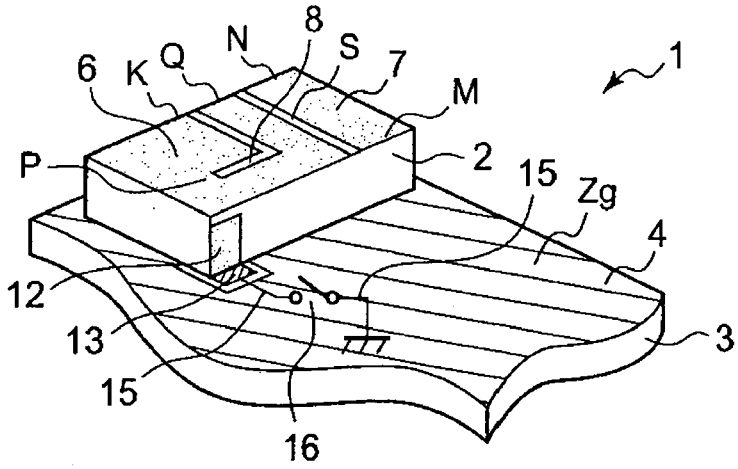
FIG. 1*a* is a perspective view schematically showing an antenna structure according to a first embodiment.

1 antenna structure
2 base
3 circuit board
4 ground electrode
6 driven radiating or feeding electrode
7 parasitic radiating or non-feeding electrode
8, 26 slits
10 wireless communication circuit
12, 27 capacitance loading electrodes
15 grounding conduction path
16 switching means
23 capacitance-loading capacitor component
30 dielectric member
P harmonic-mode zero-voltage region of driven radiating electrode
Q harmonic-mode zero-voltage region of parasitic radiating electrode Now, embodiments of the antenna structure will be described with reference to the drawings.

First Embodiment

Figure 1B:
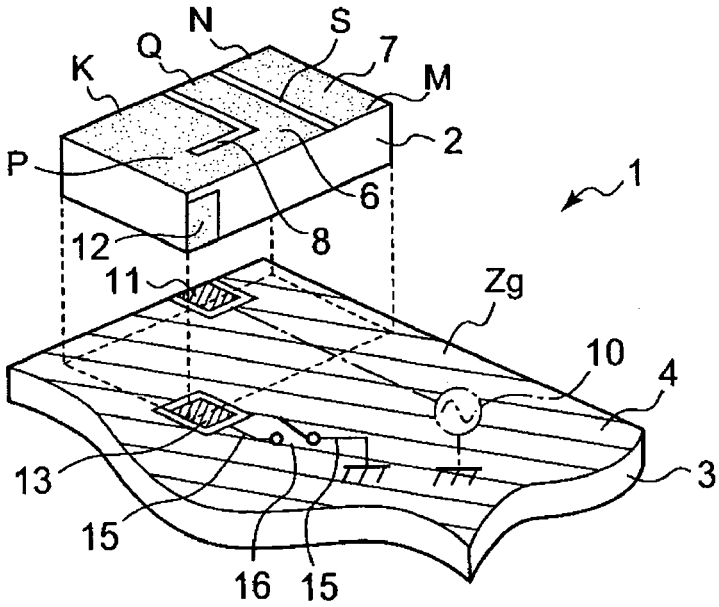
FIG. 1*b* is a schematic exploded view of the antenna structure shown in FIG. 1*a*.

FIG. 1*a* is a schematic perspective view showing an antenna structure according to a first embodiment, and FIG. 1*b* is a schematic exploded view of the antenna structure shown in FIG. 1*a*. An antenna structure 1 according to the first embodiment includes a base 2 having a rectangular parallelepiped shape. The base 2 is formed of a dielectric material, and is mounted in a ground region Zg (i.e., a region where a ground electrode 4 is formed) on a circuit board 3. The dielectric material forming the base 2 is, for example, a ceramic, a resin, or a dielectric material composed of a mixture of a resin material and ceramic powder so as to have an adjusted dielectric constant. The base 2 may have either a single-layer structure or a multi-layer structure.

In the first embodiment, on a top surface of the base 2, a driven radiating or feeding electrode 6 and a parasitic radiating or non-feeding electrode 7 are disposed adjacent to each other via (i.e., separated by) a space S. The driven radiating electrode 6 has an L-shaped slit 8 formed therein so as to cut into the driven radiating electrode 6 from an end edge of the electrode 6. At the end edge of the driven radiating electrode 6 on the side of the opening of the cutting of the slit 8, with the slit 8 in the middle, one side Q serves as a feeding end and the other side K serves as an open end. Since the feeding end Q and the open end K are disposed adjacent to each other via the slit 8 in the driven radiating electrode 6 as described above, a current path between the feeding end Q and the open end K has a loop shape extending around the slit 8 and connecting the feeding end Q and the open end K. By forming the slit 8 in the driven radiating electrode 6 so that the driven radiating electrode 6 has a loop-shaped current path, it is possible to increase the electrical length of the driven radiating electrode 6 without increasing the size of the driven radiating electrode 6. Furthermore, compared with a case where a loop-shaped driving radiating electrode is formed using strip-shaped electrodes, it is possible to increase the electrode area of the driven radiating electrode 6. The increase in the electrode area serves to reduce current loss of the driven radiating electrode 6, and to increase the bandwidth of the frequency band of the driven radiating electrode 6.

On the circuit board 3, a wireless communication circuit (a high-frequency circuit) 10 is formed. Furthermore, on the surface of a region where the base 2 is mounted on the circuit board 3, a feeding electrode land 11 electrically connected to the wireless communication circuit 10 is provided in such a manner that the feeding electrode land 11 is electrically insulated from the ground electrode 4 via a space. On a side surface of the base 2, a driven electrode (not shown) for electrically connecting the feeding end Q of the driven radiating electrode 6 and the feeding electrode land 11 on the circuit board 3 is formed. The feeding end Q of the driven radiating electrode 6 is electrically connected to the wireless communication circuit 10 on the circuit board 3 via the driven electrode and the feeding electrode land 11. The driven radiating electrode 6 is electrically connected to the wireless communication circuit 10, and functions as a radiating electrode that performs antenna operations.

Figure 2A:
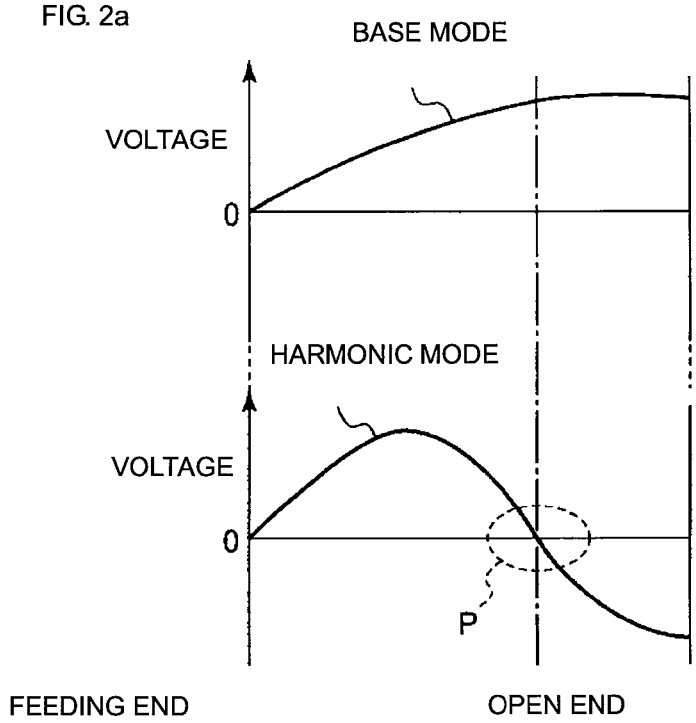
FIG. 2*a* is a graph for explaining voltage distributions of a driven radiating electrode in the antenna structure according to the first embodiment.
Figure 2B:
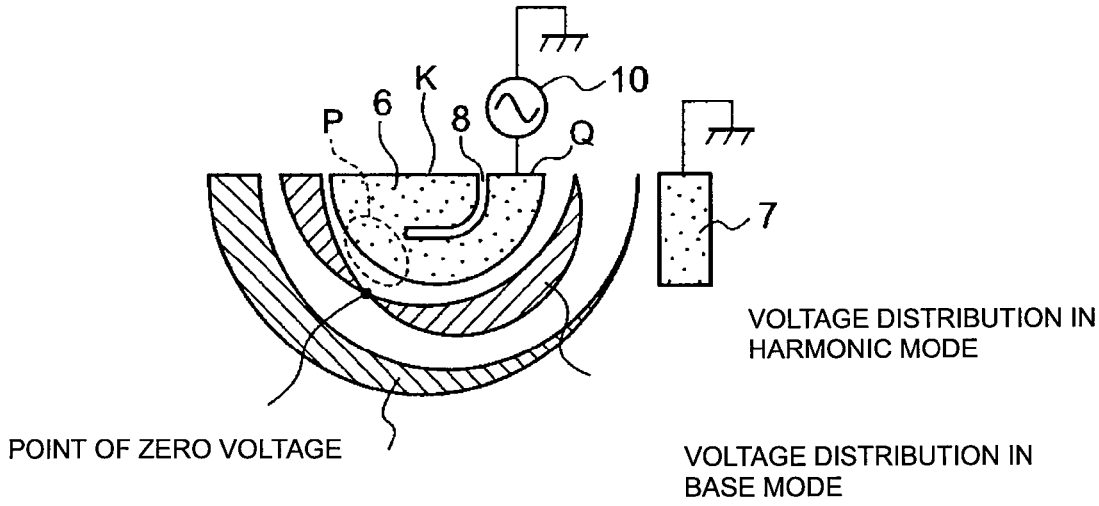
FIG. 2*b* is a model diagram showing an image of an example of relationship between the driven radiating electrode and voltage distributions thereof.

In the first embodiment, the driven radiating electrode 6 performs antenna operations in a plurality of resonant frequency bands different from each other. In this specification, a lowest resonant frequency band among the plurality of resonant frequency bands of the driven radiating electrode 6 will be referred to as a base resonant frequency band, and an antenna operation mode in the base resonant frequency band will be referred to as a base mode. Furthermore, a resonant frequency band that is higher than the base resonant frequency band will be referred to as a harmonic resonant frequency band, and an antenna operation in the harmonic resonant frequency band will be referred to as a harmonic mode. FIG. 2*a* shows graphs of voltage distributions in the base mode and the harmonic mode of the driven radiating electrode 6. Furthermore, FIG. 2*b* shows image diagrams for facilitating recognition of areas of the voltage distributions in the base mode and the harmonic mode of the driven radiating electrode 6. As shown in FIGS. 2*a* and 2*b*, in the first embodiment, a region of the driven radiating electrode 6 in which the voltage becomes zero or nearly zero in the harmonic mode (harmonic-mode zero-voltage region) corresponds to a region P where the end of cutting of the slit 8 is formed (i.e., a region of turnback of the current path extending around the slit).

On a side surface of the base 2, a capacitance loading electrode 12 that serves as capacitance loading means for loading a capacitance to the harmonic-mode zero-voltage region P of the driven radiating electrode 6 is formed. Furthermore, on the surface of the circuit board 3, an electrode land 13 electrically connected to the capacitance loading electrode 12 is formed in such a manner that the electrode land 13 is electrically insulated from the ground electrode 4 via a space. Furthermore, on the circuit board 3, a grounding conduction path 15 is formed. One end of the grounding conduction path 15 is electrically connected to the electrode land 13, and the other end thereof may be electrically connected to the ground electrode 4. That is, the grounding conduction path 15 is a conduction path for causing the capacitance loading electrode 12 to be grounded to the ground electrode 4 via the electrode land 13. In the grounding conduction path 15, switching means 16 for switching ON/OFF of the conduction of the grounding conduction path 15 is provided.

When the switching means 16 is ON, the capacitance loading electrode 12 is grounded to the ground electrode 4. Thus, a capacitor is formed between the harmonic-mode zero-voltage region P of the driven radiating electrode 6 and the capacitance loading electrode 12, so that a capacitance with the ground is loaded to the harmonic-mode zero-voltage region P. On the other hand, when the switching means 16 is OFF, the capacitance loading electrode 12 is electrically disconnected from the ground electrode 4 and becomes electrically floating. Thus, no capacitor is formed between the harmonic-mode zero-voltage region P of the driven radiating electrode 6 and the capacitance loading electrode 12, so that no capacitance by the capacitance loading electrode 12 with the ground is loaded to the harmonic-mode zero-voltage region P.

The parasitic radiating electrode 7 has one end M that serves as an open end and the other end N that serves as a shorted end. On a side surface of the base 2, a grounding electrode (not shown) for electrically connecting the shorted end of the parasitic radiating electrode 7 to the ground electrode 4 is formed. In the first embodiment, the parasitic radiating electrode 7 is designed so as to be electromagnetically coupled to the driven radiating electrode 6 so that the parasitic radiating electrode 7 together with the driven radiating electrode 6 performs an antenna operation and causes multiple resonance in the harmonic resonant frequency band of the driven radiating electrode 6.

The antenna structure 1 according to the first embodiment has the structure described above. In the antenna structure 1, it is possible to switch the base resonant frequency in the base resonant frequency band of the driven radiating electrode 6 as described below. For example, let it be assumed that, when the switching means 16 is OFF, the base resonant frequency of the driven radiating electrode 6 is, for example, a frequency $F_{b6}$ shown in FIG. 1*c*, the harmonic resonant frequency of the driven radiating electrode 6 is, for example, $F_{h6}$, the resonant frequency of the parasitic radiating electrode 7 is $F_{b7}$, and the antenna structure 1 has return loss characteristics indicated by a solid line α shown in FIG. 1*c* by resonant operations of the driven radiating electrode 6 and the parasitic radiating electrode 7. On the other hand, when the switching means 16 is switched to ON, a capacitance formed by the capacitance loading electrode 12 with the ground is loaded to the harmonic-mode zero-voltage region P. Thus, as indicated by a chain line P in FIG. 1*c*, the harmonic resonant frequency of the driven radiating electrode 6 and the resonant frequency of the parasitic radiating electrode 7 do not change, and only the base resonant frequency of the driven radiating electrode 6 changes to be lower, and the base resonant frequency of the driven radiating electrode 6 is switched to, for example, a frequency $F_{b6}'$.

The width of change of the switching of the base resonant frequency of the driven radiating electrode 6 at the time of switching of the switching means 16 from OFF to ON corresponds to the magnitude of the capacitance between the harmonic-mode zero-voltage region P of the driven radiating electrode 6 and the capacitance loading electrode 12 (i.e., the capacitance between the harmonic-mode zero-voltage region P of the driven radiating electrode 6 and the ground, loaded to the harmonic-mode zero-voltage region P by the capacitance loading electrode 12). Thus, in the first embodiment, the space between the harmonic-mode zero-voltage region P of the driven radiating electrode 6 and the capacitance loading electrode 12, the electrode width of the capacitance loading electrode 12, and so forth are designed so that a capacitance is formed between the harmonic-mode zero-voltage region P of the driven radiating electrode 6 and the capacitance loading electrode 12, such that the base resonant frequency of the driven radiating electrode 6 becomes a predetermined frequency when the switching means 16 is ON.

Since the base resonant frequency band of the driven radiating electrode 6 can be switched as described above, the following advantage can be achieved. Let it be supposed that, for example, a wireless communication system A performs wireless communication using a frequency band A shown in FIG. 1*c*, and another wireless communication system B performs wireless communication using a frequency band B. In this case, when the switching means 16 is ON, the base resonant frequency band of the driven radiating electrode 6 becomes that corresponding to the frequency band A for the wireless communication system A. On the other hand, when the switching means 16 is OFF, the base resonant frequency band of the driven radiating electrode 6 becomes that corresponding to the frequency band B for the wireless communication system B. That is, in a configuration without ON/OFF switching of capacitance loading by the capacitance loading electrode 12 to the harmonic-mode zero-voltage region P of the driven radiating electrode 6, the base resonant frequency band of the driven radiating electrode 6 can cover only either one of the frequency band A and the frequency band B. In contrast, with a configuration in which it is possible to control ON/OFF switching of capacitance loading by the capacitance loading electrode 12 to the harmonic-mode zero-voltage region P of the driven radiating electrode 6, the base resonant frequency band of the driven radiating electrode 6 can cover both the frequency band A and the frequency band B. That is, it is possible to increase the base frequency band of the driven radiating electrode 6.

Furthermore, in the first embodiment, since the capacitance by the capacitance loading electrode 12 is loaded to the harmonic-mode zero-voltage region P of the driven radiating electrode 6, the multiple resonance by the harmonic mode of the driven radiating electrode 6 and the parasitic radiating electrode 7 is not affected by ON/OFF switching of the switching means 16. Thus, occurrence of the following problem can be avoided. For example, let it be supposed that a wireless communication system C performs wireless communication using a frequency band C shown in FIG. 1*c*, another wireless communication system D performs wireless communication using a frequency band D, and yet another wireless communication system E performs wireless communication using a frequency band E. Let it be assumed that, in this case, the multiple resonance by the harmonic mode of the driven radiating electrode 6 and the parasitic radiating electrode 7 serves to increase the bandwidth of the harmonic resonant frequency band of the driven radiating electrode 6 so that the harmonic resonant frequency band of the driven radiating electrode 6 can cover all the frequency bands C, D, and E when the switching means 16 is OFF. In this case, when the switching means 16 is switched from OFF to ON so that the harmonic resonant frequency $F_{h6}$ of the driven radiating electrode 6 changes to be lower (i.e., to become closer to the resonant frequency of the parasitic radiating electrode 7), the harmonic resonant frequency band of the driven radiating electrode 6 becomes narrower than in the case where the switching means 16 is OFF. Thus, for example, a problem occurs that the harmonic resonant frequency band of the driven radiating electrode 6 does not cover the frequency band E. In contrast, according to the first embodiment, the harmonic resonant frequency band of the driven radiating electrode 6 does not change even when the switching means 16 is switched ON/OFF, so that occurrence of the problem described above can be avoided.

The following describes a reason that the base resonant frequency of the driven radiating electrode 6 can be switched without changing the harmonic resonant frequency thereof by using the harmonic-mode zero-voltage region P of the driven radiating electrode 6 as a region of the driven radiating electrode 6 where a capacitance is loaded by the capacitance loading electrode 12. Since the harmonic-mode zero-voltage region P of the driven radiating electrode 6 has a voltage of zero or nearly zero in the harmonic mode, even when the switching means 16 becomes ON so that a capacitor is formed between the capacitance loading electrode 12 and the driven radiating electrode 6, in the harmonic mode of the driven radiating electrode 6, the state is equivalent to that in the case where the capacitance is not loaded to the driven radiating electrode 6. Thus, even when the switching means 16 is switched ON/OFF, the harmonic resonant frequency of the driven radiating electrode 6 does not change, so that change in the harmonic resonant frequency band of the driven radiating electrode 6 in the multiple resonance by the harmonic mode of the driven radiating electrode 6 and the parasitic radiating electrode 7 is suppressed. In contrast, in the base mode, the harmonic-mode zero-voltage region P of the driven radiating electrode 6 is a region where the voltage has such a degree that the region is affected by loading of a capacitance by the capacitance loading electrode 12. Thus, it is possible to switch the base resonant frequency of the driven radiating electrode 6 by ON/OFF of capacitance loading by the capacitance loading electrode 12.

That is, with a configuration that allows capacitance loading to the harmonic-mode zero-voltage region P of the driven radiating electrode 6 by the capacitance loading electrode 12 and with a configuration for switching ON/OFF of the capacitance loading by the capacitance loading electrode 12, advantageously, it is possible to switch the base resonant frequency band of the driven radiating electrode 6 without changing the harmonic resonant frequency band of the driven radiating electrode 6.

Figure 3A:
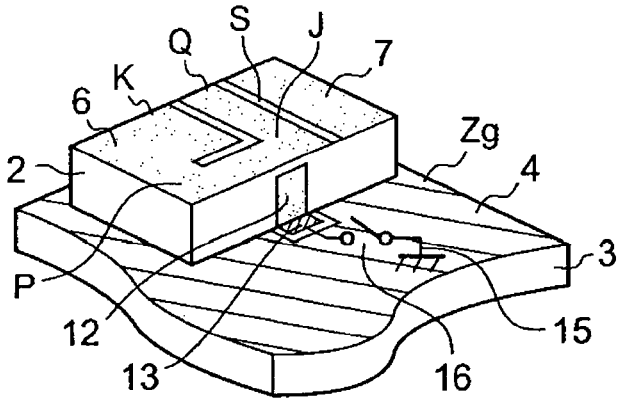
FIG. 3*a* is a model diagram showing an antenna structure that serves as a comparative example for the antenna structure according to the first embodiment.
Figure 3B:
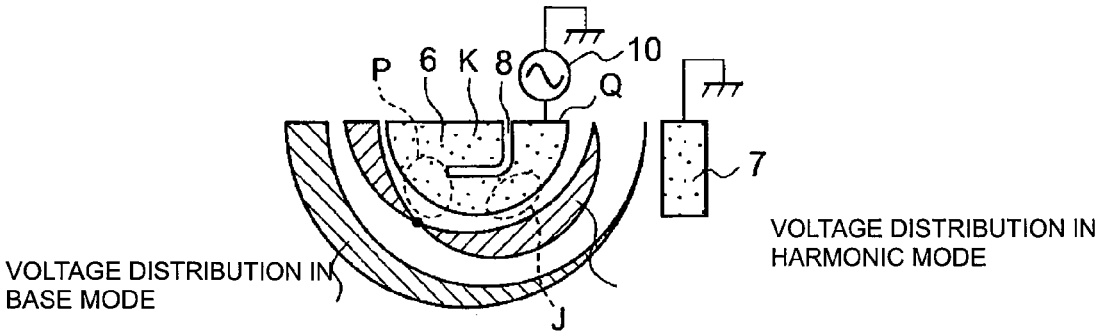
FIG. 3*b* is a model diagram showing an image of an example of relationship between the driven radiating electrode in the antenna structure shown in FIG. 3*a* and voltage distributions thereof.
Figure 4A:
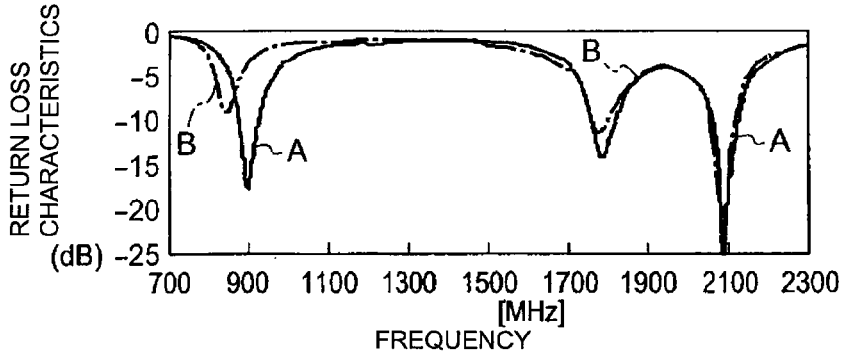
FIG. 4*a* is a graph showing return loss characteristics of the antenna structure according to the first embodiment, obtained through experiments performed by the inventors.
Figure 4B:
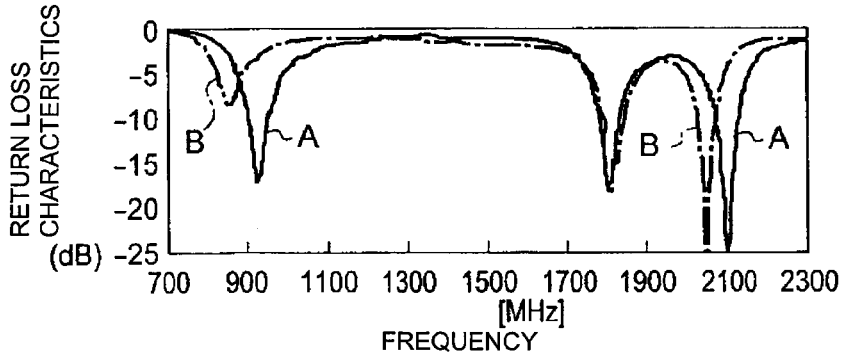
FIG. 4*b* is a graph showing return loss characteristics of the antenna structure shown in FIG. 3*a*, obtained through experiments performed by the inventors.
Figure 5A:
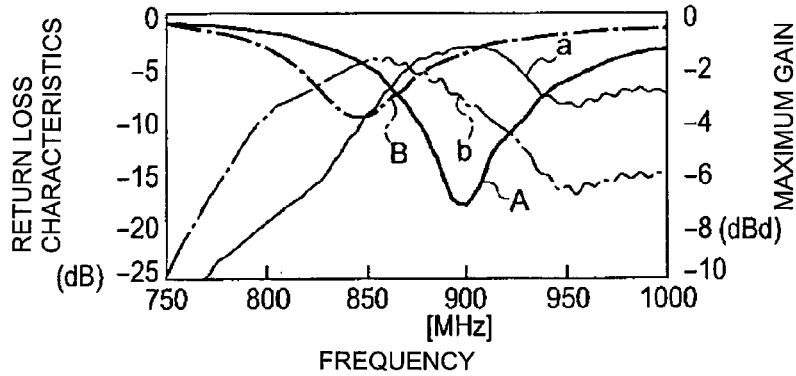
FIG. 5*a* is a graph showing results of measurement of return loss characteristics and maximum gain of the antenna structure according to the first embodiment at frequencies of 750 MHz to 1000 MHz, obtained through experiments performed by the inventors.
Figure 5B:
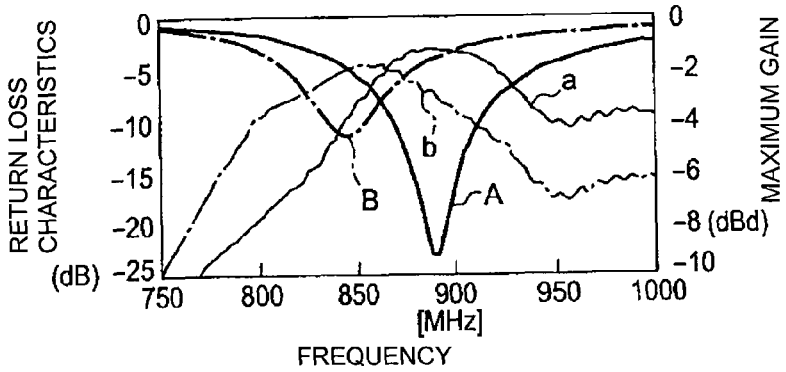
FIG. 5*b* is a graph showing results of measurement of return loss characteristics and maximum gain of the antenna structure shown in FIG. 3*a* at frequencies of 750 MHz to 1000 MHz, obtained through experiments performed by the inventors.
Figure 6A:
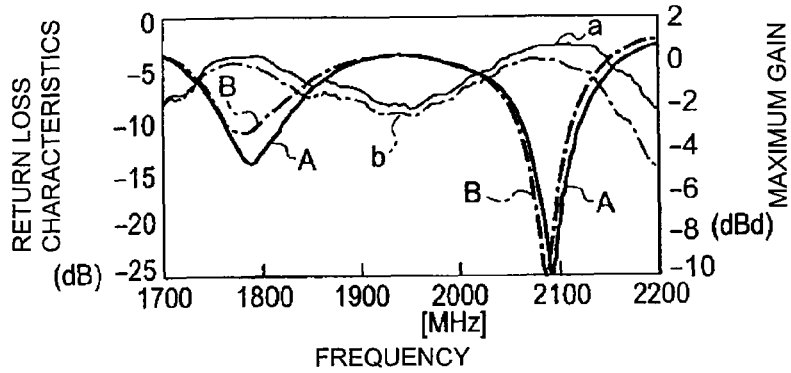
FIG. 6*a* is a graph showing results of measurement of return loss characteristics and maximum gain of the antenna structure according to the first embodiment at frequencies of 1700 MHz to 2200 MHz, obtained through experiments performed by the inventors.
Figure 6B:
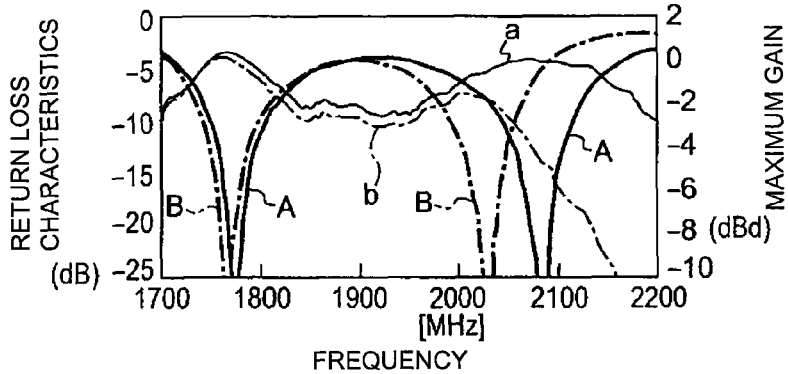
FIG. 6*b* is a graph showing results of measurement of return loss characteristics and maximum gain of the antenna structure shown in FIG. 3*a* at frequencies of 1700 MHz to 2200 MHz, obtained through experiments performed by the inventors.

This has been confirmed through experiments by the inventors. In the experiments, a sample A having the configuration of the antenna structure 1 according to the first embodiment was prepared, and a sample B shown in FIG. 3*a* was prepared as a comparative example. In the configuration of the sample B, the portion of the driven radiating electrode 6 where capacitance with the ground is loaded by the capacitance loading electrode 12 is a region J shown in FIG. 3*b*. The region J is a region that is shifted from the harmonic-mode zero-voltage region P. The configuration of the sample B is otherwise the same as that of the sample A (i.e., the antenna structure 1 according to the first embodiment). In the experiments by the inventors, for each of the samples A and B, return loss characteristics and maximum gain with the switching means 16 turned ON and with the switching means 16 turned OFF were measured (simulated). FIG. 4*a* shows the results of measurement of return loss characteristics of the sample A, and FIG. 4*b* shows the results of measurement of return loss characteristics of the sample B. In FIGS. 4*a* and 4*b*, solid lines A represent the results of measurement with the switching means 16 turned OFF, and chain lines B represent the results of measurement with the switching means 16 turned ON. Furthermore, FIG. 5*a* shows the results of measurement of return loss characteristics and maximum gain of the sample A in a frequency range of 750 MHz to 1000 MHz, and FIG. 5*b* shows the results of measurement of return loss characteristics and maximum gain of the sample B in a frequency range of 750 MHz to 1000 MHz. Furthermore, FIG. 6*a* shows the results of measurement of return loss characteristics and maximum gain of the sample A in a frequency range of 1700 MHz to 2200 MHz, and FIG. 6*b* shows the results of measurement of return loss characteristics and maximum gain of the sample B in a frequency range of 1700 MHz to 2200 MHz. In FIGS. 5*a*, 5*b*, 6*a*, and 6*b*, solid lines A represent the results of measurement of return loss characteristics with the switching means 16 turned OFF, chain lines B represent the results of measurement of return loss characteristics with the switching means 16 turned ON, solid lines a represent the results of measurement of maximum gain with the switching means 16 turned OFF, and chain lines B represent the results of measurement of maximum gain with the switching means 16 turned ON.

As represented in the measurement results shown in the graphs of FIGS. 4*a* to 6*b*, in each of the sample A and the sample B, the base resonant frequency of the driven radiating electrode 6 was switched through switching of the ON/OFF of the switching means 16 (i.e., through switching of the ON/OFF of loading of a capacitance with the ground by the capacitance loading electrode 12). The resonant frequency of the parasitic radiating electrode 7 did not change. On the other hand, through switching of the ON/OFF of capacitance loading, the harmonic resonant frequency of the driven radiating electrode 6 did not change in the sample A, while the harmonic resonant frequency of the driven radiating electrode 6 changed in the sample B. In the sample B, the change in the harmonic resonant frequency of the driven radiating electrode 6 resulted in a change in the bandwidth of the harmonic resonant frequency band of the driven radiating electrode 6 in the multiple resonance by the driven radiating electrode 6 in the harmonic mode and the parasitic radiating electrode 7.

That is, through the experiments, it has been confirmed that, by loading a capacitance with the ground to the harmonic-mode zero-voltage region P of the driven radiating electrode 6 by the capacitance loading electrode 12, and switching the ON/OFF of capacitance loading to the harmonic-mode zero-voltage region P, it is possible to switch the base resonant frequency of the driven radiating electrode 6 without changing the harmonic resonant frequency band of the driven radiating electrode 6. That is, the experiments demonstrate that if a capacitance with the ground is loaded by the capacitance loading electrode 12 to a region other than the harmonic-mode zero-voltage region P of the driven radiating electrode 6, the harmonic resonant frequency band of the driven radiating electrode 6 changes when the ON/OFF of capacitance loading is switched.

Modifications

Figure 7A:
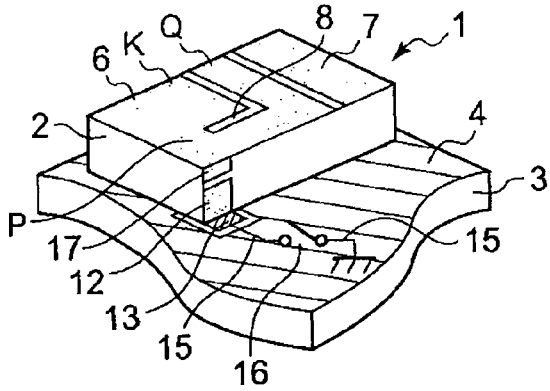
FIG. 7*a* is a model diagram for explaining another example form of capacitance loading means.

Although capacitance loading means is formed by the capacitance loading electrode 12 in the examples shown in FIGS. 1*a* and 1*b*, for example, capacitance loading means may be formed by an extended electrode 17 and a capacitance loading electrode 12 as shown in FIG. 7*a*. The extended electrode 17 is formed so as to extend from the harmonic-mode zero-voltage region P of the driven radiating electrode 6 toward the capacitance loading electrode 12 on a side surface of the base 2, thereby forming a capacitor with the capacitance loading electrode 12. The capacitance between the extended electrode 17 and the capacitance loading electrode 12 is loaded in the harmonic-mode zero-voltage region P of the driven radiating electrode 6 as a capacitance with the ground.

Figure 7B:
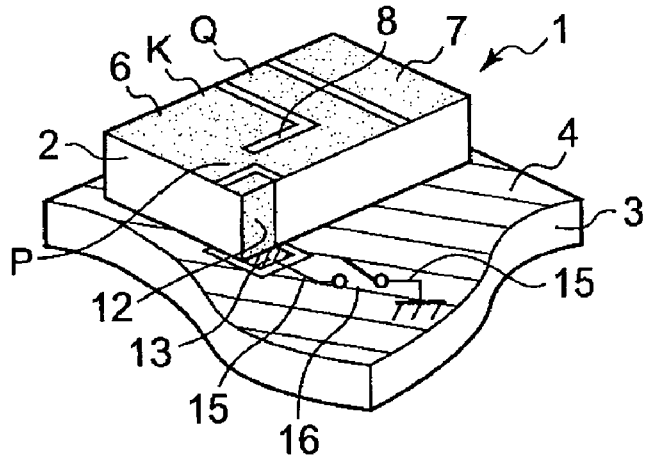
FIG. 7*b* is a model diagram for explaining yet another example form of capacitance loading means.
Figure 7C:
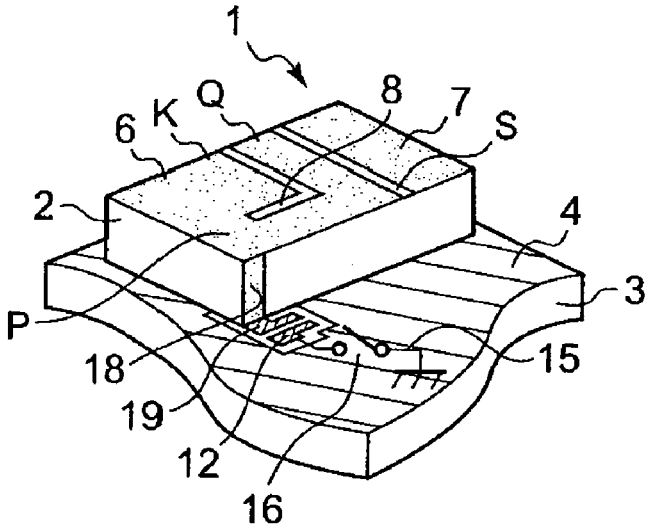
FIG. 7*c* is a model diagram for explaining still another example form of capacitance loading means.

Furthermore, although the capacitance loading electrode 12 is formed so as to extend from an end edge on the bottom surface of the base 2 to a side surface of the base 2 in the examples shown in FIGS. 1*a* and 1*b*, the capacitance loading electrode 12 may be formed so as to extend further on the upper end side of the capacitance loading electrode 12 to reach the top surface of the base 2, thereby forming a capacitor with the harmonic-mode zero-voltage region P of the driven radiating electrode 6, as shown in FIG. 7*b*. Furthermore, although the capacitance loading electrode 12 is formed on the base 2 in the examples shown in FIGS. 1*a* and 1*b*, for example, the capacitance loading electrode 12 may be formed on the circuit board 2. In this case, for example, an extended electrode 18 is formed so as to extend from the harmonic-mode zero-voltage region P of the driven radiating electrode 6 to the bottom surface of the base 2 via a side surface of the base 2, as shown in FIG. 7*c*. Furthermore, on the circuit board 2, an electrode land 19 electrically connected to the extended electrode 18 is formed in such a manner that the electrode land 19 is electrically insulated from the ground electrode 4. The capacitance loading electrode 12 is formed on the circuit board 2 so as to form a capacitor with the electrode land 19. In this case, capacitance loading means is formed by the extended electrode 18, the electrode land 19, and the capacitance loading electrode 12, and the capacitance between the electrode land 19 and the capacitance loading electrode 12 is loaded in the harmonic-mode zero-voltage region P of the driven radiating electrode 6.

Figure 7D:
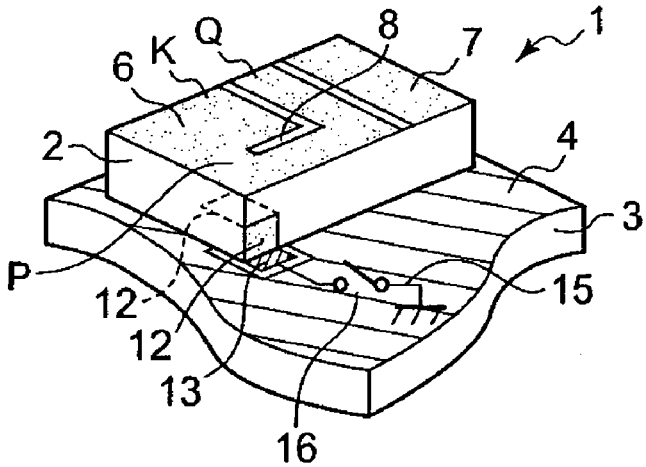
FIG. 7*d* is a model diagram for explaining a further example form of capacitance loading means.

Furthermore, although the capacitance loading electrode 12 is formed so as to extend from an end edge on the bottom surface of the base 2 to a side surface of the base 2 in the examples shown in FIGS. 1*a* and 1*b*, for example, at least part of the capacitance loading electrode 12 may be formed inside the base 2, as shown in FIG. 7*d*. With the configuration in which at least part of the capacitance loading electrode 12 is formed inside the base 2 as described above, it becomes readily possible to increase the electrode area of the capacitance loading electrode 12 opposing the driven radiating electrode 6. Thus, it becomes easier to increase the capacitance between the driven radiating electrode 6 and the capacitance loading electrode 12 (i.e., the capacitance with the ground electrode 4, loaded to the driven radiating electrode 6). Therefore, the variable adjustment range of the capacitance with the ground electrode 4, loaded by the capacitance loading electrode 12 to the driven radiating electrode 6, is increased. That is, it is possible to increase the variable range of change the width of change in the base resonant frequency of the driven radiating electrode 6 at the time of switching of the switching means 16 from OFF to ON. Furthermore, the flexibility of the position of forming the capacitance loading electrode 12 is increased. Thus, advantageously, it becomes more readily possible to meet the needs for various frequency bands.

Figure 7E:
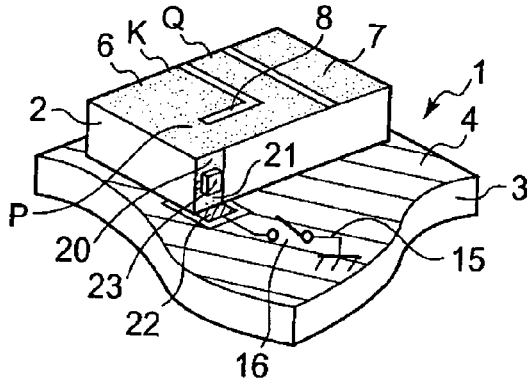
FIG. 7*e* is a model diagram for explaining a still further example form of capacitance loading means.

Furthermore, although capacitance loading means is formed by the capacitance loading electrode 12 in the examples shown in FIGS. 1*a* and 1*b*, for example, capacitance loading means may be formed by a capacitance-loading capacitor component for capacitance loading. In a case where the capacitance-loading capacitor component is provided on the base 2, for example, an extended electrode 20 is formed so as to extend from the harmonic-mode zero-voltage region P of the driven radiating electrode 6 to a side surface of the base 2, as shown in FIG. 7*e*, and an electrode 21 is formed with a gap from the extended electrode 20 so as to extend from the bottom surface of the base 2 toward the extended electrode 20. The electrode 21 is electrically connected to the grounding conduction path 15 via an electrode land 22 formed on the circuit board 2. A capacitance-loading capacitor component 23 is provided so as to bridge between the extended electrode 20 and the electrode 21. The capacitance of the capacitance-loading capacitor component 23 is loaded in the harmonic-mode zero-voltage region P of the driven radiating electrode 6 as a capacitance between the harmonic-mode zero-voltage region P of the driven radiating electrode 6 and the ground. The capacitance-loading capacitor component 23 may be a capacitor component having a fixed capacitance determined in advance, or a variable-capacitance capacitor component that allows variable adjustment of the magnitude of its capacitance. Furthermore, in the case where a variable-capacitance capacitor component is provided as the capacitance-loading capacitor component 23, voltage application means for setting the capacitance of the variable-capacitance capacitor component is provided.

With the capacitance loading means formed by the capacitance-loading capacitor component 23 as described above, the following advantages can be achieved. The width of change in the base resonant frequency of the driven radiating electrode 6 at the time of switching of the switching means 16 from OFF to ON corresponds to capacitance between the driven radiating electrode 6 and the ground, loaded by the capacitance loading means. Thus, by forming capacitance loading means by the capacitance-loading capacitor component 23, particularly by a variable-capacitance capacitor component that allows continuous changing of capacitance, it becomes readily possible to precisely adjust the width of change in the base resonant frequency of the driven radiating electrode 6 at the time of switching of the switching means 16 from OFF to ON to a predetermined width of change. Accordingly, the antenna structure 1 and a wireless communication apparatus having frequency characteristics more suitable for the needs can be readily provided.

Furthermore, in the case where capacitance loading means is formed by the capacitance loading electrode 12, the magnitude of capacitance that can be loaded to the driven radiating electrode 6 by the capacitance loading electrode 12 is restricted, for example, by restriction of size, formation region, or the like. In contrast, by forming capacitance loading means by the capacitance-loading capacitor component 23, compared with the case where capacitance loading means is formed by the capacitance loading electrode 12, it is possible to increase the capacitance with the ground electrode 4, loaded to the driven radiating electrode 6 by the capacitance loading means. Thus, it is possible to increase the variable range of the width of change in the base resonant frequency of the driven radiating electrode 6 at the time of switching of the switching means 16 from OFF to ON. This results in an advantage that it becomes more readily possible to meet the needs for various frequency bands. In the case where capacitance loading means is formed by the capacitance loading electrode 12, advantageously, since the capacitance-loading capacitor component 23 is not needed, it is possible to alleviate increase in the number of parts, and structural complexity can be avoided.

Second Embodiment

Now, a second embodiment will be described. In the description of the second embodiment, components that are the same as those in the first embodiment are designated by the same numerals, and repeated description of the common components will be omitted.

Figure 8A:
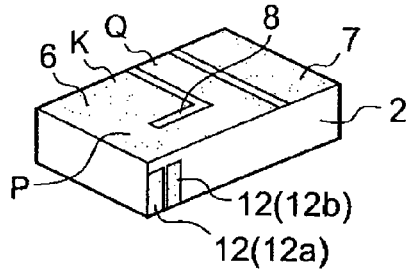
FIG. 8*a* is a model diagram showing an example form of an antenna component in an antenna structure according to a second embodiment.

In the second embodiment, as shown in FIG. 8*a*, a plurality of (two in the example shown in FIG. 8*a*) capacitance loading electrodes 12 (12*a* and 12*b*) are provided on the base 2. By forming a plurality of capacitance loading electrodes 12 on the base 2 as described above, it is possible to form a plurality of types of antenna structures using the base 2 having formed thereon the plurality of capacitance loading electrodes 12, the driven radiating electrode 6, the parasitic radiating electrode 7, and so forth (such a base 2 will hereinafter be referred to as an antenna component). The plurality of capacitance loading electrodes 12 may be formed so that different capacitances can be loaded in the harmonic-mode zero-voltage region P of the driven radiating electrode 6, or so that all the capacitance loading electrodes 12 can load the same capacitance in the harmonic-mode zero-voltage region P of the driven radiating electrode 6, as determined appropriately.

Figure 8B:
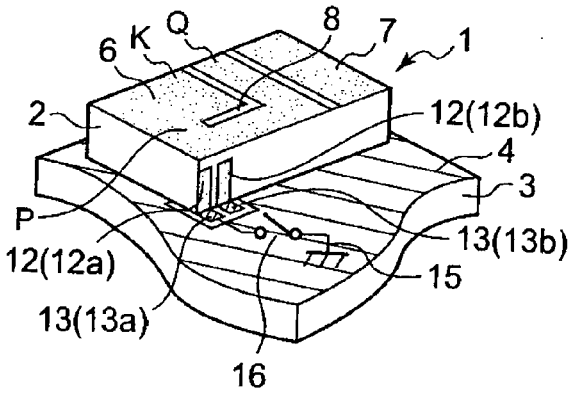
FIG. 8*b* is a model diagram showing an antenna structure having a configuration characteristic of the second embodiment.
Figure 8C:
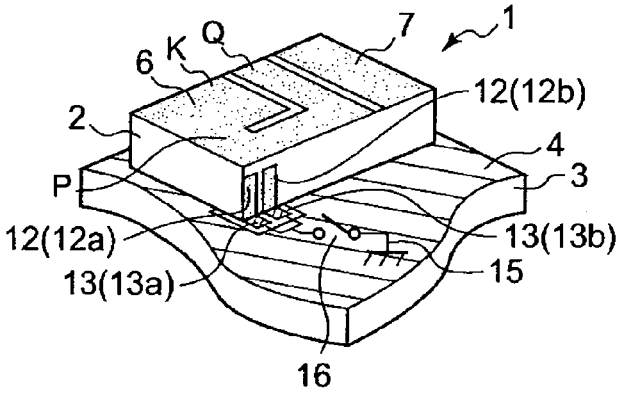
FIG. 8*c* is a model diagram showing another antenna structure having a configuration characteristic of the second embodiment.
Figure 8D:
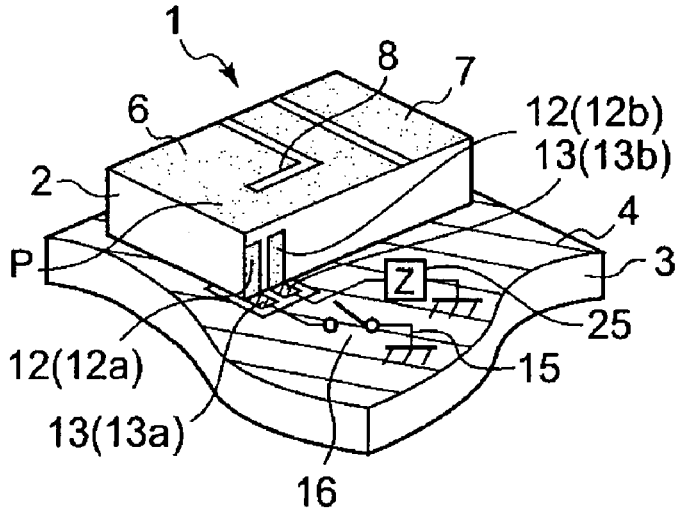
FIG. 8*d* is a model diagram showing yet another antenna structure having a configuration characteristic of the second embodiment.

Now, an example configuration of an antenna structure 1 including the antenna component shown in FIG. 8*a* will be described. For example, in a case where it suffices to use only one of the plurality of capacitance loading electrodes 12 in the antenna component in order to set the base resonant frequency of the driven radiating electrode 6 with capacitance loading turned ON to a predetermined frequency, only the needed capacitance loading electrode 12 is electrically connected to the ground electrode 4 by the grounding conduction path 15 via the switching means 16, as shown in FIG. 8*b*. In this configuration of the antenna structure 1, a capacitance loading electrode 12 that is not used exists. The capacitance loading electrode 12 that is not used (the capacitance loading electrode 12 (12*b*) in the example shown in FIG. 8*b*) may be electrically floating as shown in FIG. 8*b*. Alternatively, as shown in FIG. 8*d*, a load 25 may be connected to the capacitance loading electrode 12 (12*b*) that is not used, the load 25 having an electrical impedance Z when viewed in the direction from the capacitance loading electrode 12 (12*b*) that is not used toward the electrode land 13 (13*b*).

Figure 8E:
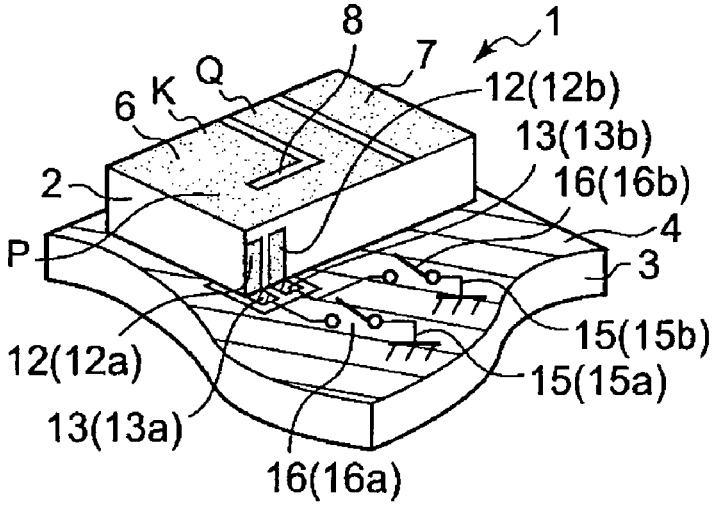
FIG. 8*e* is a model diagram showing still another antenna structure having a configuration characteristic of the second embodiment.

Now, another example configuration of an antenna structure 1 including the antenna component shown in FIG. 8*a* will be described. For example, in a case where a plurality of capacitance loading electrodes 12 of the antenna component 1 is needed in order to set the base resonant frequency of the driven radiating electrode 6 with capacitive loading turned ON to a predetermined frequency, as shown in FIG. 8*c*, a plural number of capacitance loading electrodes 12 as needed is connected to the ground electrode 4 via the grounding conduction path 15 via common switching means 16. Alternatively, as shown in FIG. 8*e*, the capacitance loading electrodes 12 may be electrically connected to the ground electrode 4 by the grounding conduction path 15 via individually associated switching means 16. In this case, all the switching means 16 associated with the plurality of capacitance loading electrodes 12 needed for capacitance loading are simultaneously controlled to turn ON or OFF.

In the example of the antenna structure 1 shown in FIG. 8*e*, the capacitance loading electrodes 12 of the antenna component are grounded to the ground electrode 4 by the grounding conduction path 15 via individually associated switching means 16. In the case of the configuration where a plurality of capacitance loading electrodes 12 are connected to the ground electrode 4 by the grounding conduction path 15 via individually associated switching means 16, the following schemes are possible: ON/OFF switching of one of the plurality of switching means is controlled, ON/OFF switching of all the switching means 16 is simultaneously controlled, or ON/OFF switching of a plurality of switching means 16 selected in advance is controlled (including multiple-stage control depending on combination). That is, through selection of switching means 16 with which ON/OFF switching is controlled, or by the number or combination of switching means 16 that are used, variable adjustment of the magnitude of capacitance with the ground electrode 4, loaded to the harmonic-mode zero-voltage region P of the driven radiating electrode 6 by capacitance loading means, is allowed. Thus, even in the same antenna structure, it is possible to vary the base resonant frequency of the driven radiating electrode 6 with capacitance loading turned ON. Thus, the antenna structure 1 in which a plurality of capacitance loading electrodes 12 of the antenna component are connected to the ground electrode 4 via individually associated switching means 16 can be included in a plurality of types of wireless communication apparatuses.

Although two capacitance loading electrodes 12 are formed in the examples shown in FIGS. 8*a* to 8*e*, obviously, the number of capacitance loading electrodes 12 is not limited to that number as long as it is plural, and three or more capacitance loading electrodes 12 may be formed as needed. Furthermore, the form or shape of the capacitance loading electrodes 12 is not limited to that shown in FIG. 8*a* and so forth. For example, at least one of a plurality of capacitance loading electrodes 12 may have a form shown in, for example, FIG. 7*b* or FIG. 7*d*. Furthermore, at least one of a plurality of capacitance loading electrodes 12 may be configured so that a capacitor is formed with an extended electrode 17 formed so as to extend from the harmonic-mode zero-voltage region P of the driven radiating electrode 6 and the capacitance is loaded in the harmonic-mode zero-voltage region P of the driven radiating electrode 6 as a capacitance with the ground. Furthermore, although the second embodiment is an example where the capacitance loading electrodes 12 are provided as capacitance loading means, for example, a plurality of capacitance-loading capacitor components 23 may be provided on the base 2 as capacitance loading means, as shown in FIG. 7*e*. Also in this case, a plurality of types of antenna structures 1 can be constructed using an antenna component having the plurality of capacitance-loading capacitance components 23.

In the second embodiment, a plurality of capacitance loading means is provided on the base 2, and at least one of the plurality of capacitance loading means is electrically connected to the ground electrode 4 by the grounding conduction path 15 via switching means 16. Thus, cost of the antenna structure 1 can be reduced by the following reason. Depending on difference among the types or models of wireless communication apparatuses in which the antenna structure 1 is included, the required width of change in the base resonant frequency of the driven radiating electrode 6 at the time of switching of capacitance loading from OFF to ON differs. Thus, a possible approach is to manufacture antenna components for individual types or models of wireless communication apparatuses, each of the antenna components including capacitance loading means provided on the base 2 together with the driven radiating electrode 6, the capacitance loading means serving to load a capacitance with the ground electrode 4 to the harmonic-mode zero-voltage region P of the driven radiating electrode 6 in order to achieve the required width of change. In this case, however, since antenna components must be manufactured for individual types or models of wireless communication apparatuses, a large number of types of wireless communication apparatuses is needed. In contrast, by providing in an antenna component a plurality of capacitance loading means for loading mutually different capacitances to the harmonic-mode zero-voltage region P of the driven radiating electrode 6, and connecting the capacitance loading means to the ground electrode 4 on the circuit board 3 by the grounding conduction path 15 via the switching means 16 in accordance with a predetermined width of change in the base resonant frequency of the driven radiating electrode 6 by switching of capacitance loading between OFF and ON, it is possible to provide the same type of antenna component in a plurality of types of wireless communication apparatuses. That is, use of common antenna components is allowed. Thus, cost of the antenna structure 1 and wireless communication apparatuses including the antenna structure 1 can be reduced.

Third Embodiment

Now, a third embodiment will be described. In the description of the third embodiment, components that are the same as those in the first and second embodiments are designated by the same numerals, and repeated description of the common components will be omitted.

In the third embodiment, in addition to the configuration of the first or second embodiment, the parasitic radiating electrode 7 has a loop-shaped current path. For example, in an example shown in FIG. 9*a*, the parasitic radiating electrode 7 has a slit 26 formed so as to cut in from an end edge of the parasitic radiating electrode 7. At the electrode end edge on the side of the opening of the cutting of the slit 26, with the slit 26 in the middle, one end N serves as a shorted end electrically connected to the ground electrode 4, and the other end M serves as an open end. A current path between the shorted end N and the open end M is a loop-shaped path extending around the slit 26 and connecting the feeding end N and the open end M.

In the third embodiment, the parasitic radiating electrode 7 performs antenna operations in a plurality of resonant frequency bands different from each other. A base resonant frequency $F_{b7}$ in a base resonant frequency band, which has lowest frequencies among the plurality of resonant frequency bands of the parasitic radiating electrode 7, is chosen to be, for example, a frequency in the vicinity of the base resonant frequency $F_{b6}$ of the driven radiating electrode 6, and the antenna operation (base mode) in the base resonant frequency band of the parasitic radiating electrode 7 causes multiple resonance together with the base mode of the driven radiating electrode 6, for example, as indicated by a solid lie α in FIG. 9*b*. Furthermore, a harmonic resonant frequency $F_{h7}$ in the harmonic resonant frequency band, which is higher than the base resonant frequency band of the parasitic radiating electrode 7, is chosen to be a frequency in the vicinity of the harmonic resonant frequency $F_{h6}$ of the driven radiating electrode 6, and the antenna operation (harmonic mode) in the harmonic resonant frequency band of the parasitic radiating electrode 7 causes multiple resonance together with the harmonic mode of the driven radiating electrode 6. As described above, the parasitic radiating electrode 7 causes multiple resonance both in the base resonant frequency band and the harmonic resonant frequency band of the driven radiating electrode 6. This multiple resonance allows increasing the bandwidth of the base resonant frequency band as well as the harmonic resonant frequency band of the driven radiating electrode 6.

Figure 9A:
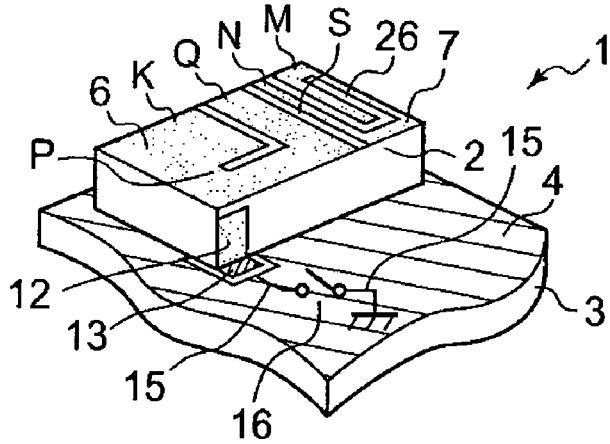
FIG. 9*a* is a model diagram showing an antenna structure at a third embodiment.
Figure 9B:
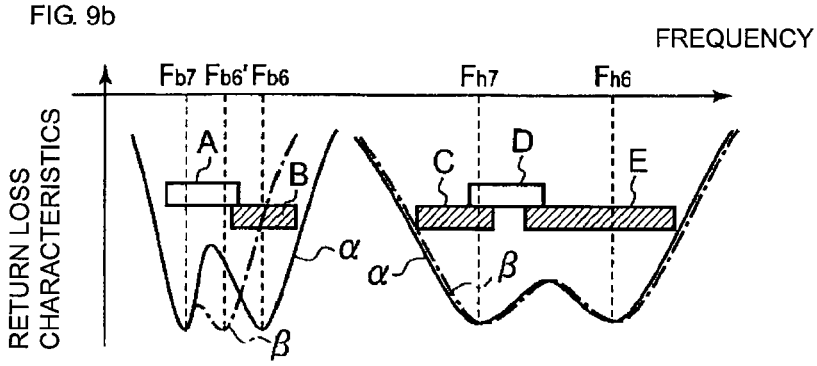
FIG. 9*b* is a graph showing return loss characteristics of the antenna structure shown in FIG. 9*a*.

Also in a case of such a configuration, in the third embodiment, similarly to the first and second embodiments, a configuration is provided that allows switching ON/OFF the capacitance loading by capacitance loading means (the capacitance loading electrode 12 in the example shown in FIG. 9*a*) to the harmonic-mode zero-voltage region P of the driven radiating electrode 6. Thus, for example, let it be supposed that, in a case where the switching means 16 is OFF so that capacitance loading by the capacitance loading means to the harmonic-mode zero-voltage region P of the driven radiating electrode 6 is OFF, the base resonant frequency of the driven radiating electrode 6 is a frequency $F_{b6}$ as indicated by the solid line α in FIG. 9*b*. In contrast, when the switching means 16 is switched to ON so that capacitance loading by the capacitance loading means to the harmonic-mode zero-voltage region P of the driven radiating electrode 6 becomes ON, the base resonant frequency of the driven radiating electrode 6 is switched to a frequency $F_{b6}'$ as indicated by the chain line P in FIG. 9*b*. As described above, even if switching of the base resonant frequency of the driven radiating electrode 6 occurs, a capacitance by the capacitance loading means is loaded to the harmonic-mode zero-voltage region P of the driven radiating electrode 6 as described earlier. Thus, as will be understood from a comparison between the solid line α and the chain line β in FIG. 9*b*, the harmonic resonant frequency band of the driven radiating electrode 6 does not change.

In the third embodiment, the parasitic radiating electrode 7 causes multiple resonance both in the base resonant frequency band and the harmonic resonant frequency band of the driven radiating electrode 6. Thus, as well as increasing the bandwidth of the base frequency band of the driven radiating electrode 6 through switching of the base resonant frequency of the driven radiating electrode 6, it is possible to increase the bandwidth of the base frequency band of the driven radiating electrode 6 by multiple resonance by the parasitic radiating electrode 7. Accordingly, it is possible to further increase the bandwidth of the base frequency band of the driven radiating electrode 6.

Furthermore, in the third embodiment, similarly to the driven radiating electrode 6, the parasitic radiating electrode 7 has a loop-shaped current path. Thus, similarly to the driven radiating electrode 6, it is possible to adjust the base resonant frequency and the harmonic resonant frequency of the parasitic radiating electrode 7 substantially independently of each other. Accordingly, it becomes readily possible to adjust the base resonant frequency and the harmonic resonant frequency of the parasitic radiating electrode 7 individually to predetermined frequencies. Furthermore, since the parasitic radiating electrode 7 also has a loop-shaped current path by forming the slit 26 in the electrode 7 similarly to the driven radiating electrode 6, advantageously, it is possible to increase the electrical length of the parasitic radiating electrode 7 without increasing the size thereof, and it is possible to increase the bandwidth of the frequency band.

In the example shown in FIG. 9*a*, the capacitance loading electrode 12 shown in FIG. 1*a* is used as capacitance loading means. Obviously, capacitance loading means may have other configurations, such as those shown in FIGS. 7*a* to 7*e* or those in the second embodiment, as described earlier.

Fourth Embodiment

Now, a fourth embodiment will be described. In the description of the fourth embodiment, components that are the same as those in the first to third embodiments will be designated by the same numerals, and repeated description of the common components will be refrained.

In the fourth embodiment, in addition to the configuration of the third embodiment, capacitance loading means for loading a capacitance to a region of the parasitic radiating electrode 7 where the voltage becomes zero or nearly zero in the harmonic mode of the parasitic radiating electrode 7 (a harmonic-mode zero-voltage region) is provided. For example, in an example shown in FIG. 10*a*, the parasitic radiating electrode 7 has such a form that a current path between the shorted end N and the open end M thereof has a loop shape extending around the slit 26 and connecting the shorted end N and the open end M. A turnback region U of the current path extending around the slit 26 of the parasitic radiating electrode 7 serves as the harmonic-mode zero-voltage region. On the base 2, a capacitance loading electrode 27 is formed, which serves as parasitic-side capacitance loading means for loading a capacitance to the harmonic-mode zero-voltage region U of the parasitic radiating electrode 7. Furthermore, on the circuit board 3, an electrode land 28 electrically connected to the capacitance loading electrode 27 is formed with a space from the ground electrode 4. The electrode land 28 and the electrode land 13 on the side of the driven radiating electrode 6 are electrically connected to the ground electrode 4 via common switching means 16 and the grounding conduction path 15.

For example, when the switching means 16 is OFF, capacitance loading by the capacitance loading electrode 12 to the harmonic-mode zero voltage region P of the driven radiating electrode 6 is OFF. Furthermore, capacitance loading by the capacitance loading electrode 27 to the harmonic-mode zero-voltage region U of the parasitic radiating electrode 7 is OFF. In this case, for example, the base resonant frequency of the driven radiating electrode 6 is a frequency $F_{b6}$ shown in FIG. 10*b*, the base resonant frequency of the parasitic radiating electrode 7 is a frequency $F_{b7}$, and the base mode of the parasitic radiating electrode 7 and the base mode of the driven radiating electrode 6 cause multiple resonance in the base resonant frequency band of the driven radiating electrode 6, as indicated by a solid line α in FIG. 10*b*. In contrast, when the switching means 16 is switched to ON, capacitance loading by the capacitance loading electrode 12 to the harmonic-mode zero voltage region P of the driven radiating electrode 6 becomes ON, and capacitance loading by the capacitance loading electrode 27 to the harmonic-mode zero-voltage region U of the parasitic radiating electrode 7 becomes ON. Thus, the base resonant frequency of the driven radiating electrode 6 is switched to a frequency $F_{b6}'$, and the base resonant frequency of the parasitic radiating electrode 7 is switched to a frequency $F_{b7}$. Accordingly, the base resonant frequency band of the driven radiating electrode 6 in the multiple resonance by the base mode of the driven radiating electrode 6 and the base mode of the parasitic radiating electrode 7 is switched as indicated by a chain line β in FIG. 10*b*.

Figure 10A:
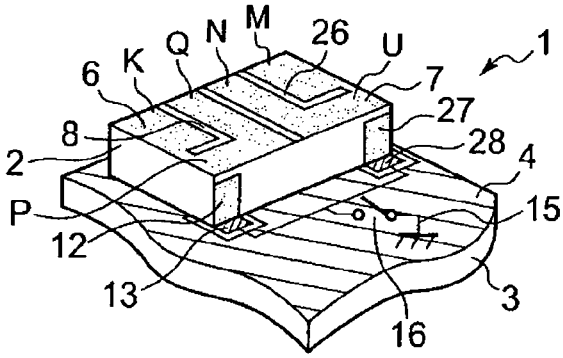
FIG. 10*a* is a model diagram showing an antenna structure according to a fourth embodiment.
Figure 10B:
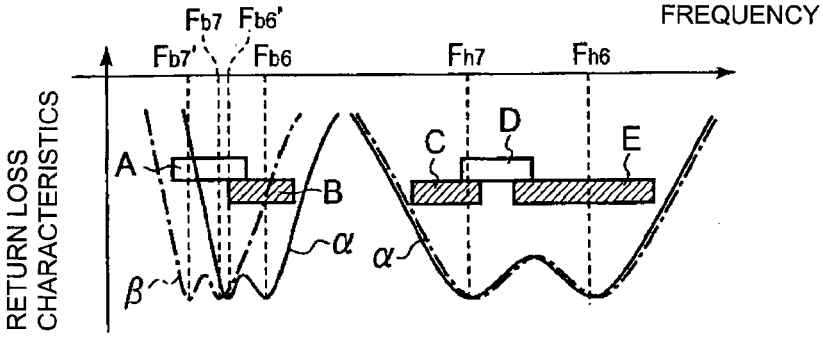
FIG. 10*b* is a graph showing return loss characteristics of the antenna structure shown in FIG. 10*a*.

Although the capacitance loading means on the side of the driven radiating electrode 6 is formed by the capacitance loading electrode 12 in the example shown in FIG. 10*a* similarly to the example shown in FIG. 1*a*, the capacitance loading means on the side of the driven radiating electrode 6 may have other configurations, such as those shown in FIGS. 7*a* to 7*e* or those in the second embodiment. Furthermore, the capacitance loading means on the side of the parasitic radiating electrode 7 may also have the various configurations similarly to the above.

Furthermore, although the capacitance loading electrodes 12 and 27 are electrically connected to the ground electrode 4 via the common switching means 16 and the grounding conduction path 15 in the example shown in FIG. 10*a*, the capacitance loading electrodes 12 and 27 may be electrically connected to the ground electrode 4 via individually associated switching means 16 and the grounding conduction path 15.

In the fourth embodiment, capacitance loading means (the capacitance loading electrode 27) is provided also for the parasitic radiating electrode 7 in order to load a capacitance to the harmonic-mode zero-voltage region thereof, similarly to the driven radiating electrode 6, it is possible to switch the base resonant frequency of the parasitic radiating electrode 7 without changing the harmonic resonant frequency of the parasitic radiating electrode 7. Thus, through switching of the base resonant frequencies of the driven radiating electrode 6 and the parasitic radiating electrode 7, it is possible to further increase the bandwidth of the base resonant frequency band.

Figure 14:
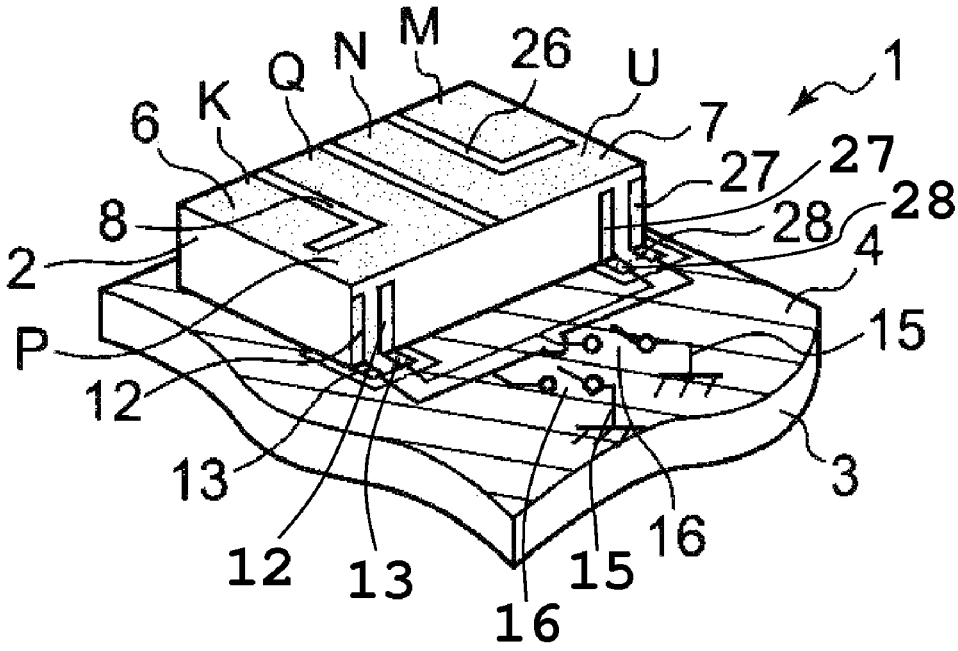
FIG. 14 is a model diagram showing a modification of the antenna structure according to the fourth embodiment.

A modification of the fourth embodiment is shown in FIG. 14. Components that are the same as those of the fourth embodiment are designated by the same numerals, and repeated description of the common components is omitted. As shown in FIG. 14, a plurality of capacitance loading electrodes 12 (similar to the second embodiment) and a plurality of capacitance loading electrodes 27 are provided, instead of the single capacitance loading electrode 12 and the single capacitance loading electrode 27 in the fourth embodiment.

Fifth Embodiment

Now, a fifth embodiment will be described. In the description of the fifth embodiment, components that are the same as those in the first to fourth embodiments will be designated by the same numerals, and repeated description of the common components will be omitted.

In the antenna structure 1, in some cases, positions where capacitance loading means can be formed are restricted due to, for example, the layout of wires on the circuit board 3. In this case, there exists a risk that the positions where capacitance loading means can be formed do not match positions where a capacitance can be loaded by capacitance loading means to the harmonic-mode zero voltage region P of the driven radiating electrode 6. The fifth embodiment has a configuration in which such a situation can be avoided. More specifically, the fifth embodiment has a configuration described below in addition to the configuration of the first to fourth embodiments.

Since the driven radiating electrode 6 is formed on the base 2, the voltage distribution at the driven radiating electrode 6 is affected by the dielectric constant of the base 2. Thus, it is possible to adjust the area of the harmonic-mode zero voltage region P of the driven radiating electrode 6 by adjusting the dielectric constant of the base 2. Based on this fact, for example, the antenna structure 1 according to the fifth embodiment is designed as follows. For example, the position of forming capacitance loading means is determined on the basis of restrictions of position of forming capacitance loading means and so forth. A region of the driven radiating electrode 6 to which a capacitance is loaded by the capacitance loading means is determined as a position where the harmonic-mode zero voltage region P is to be provided. The dielectric constant of the base 2 is determined so that the harmonic-mode zero voltage region P of the driven radiating electrode 6 is provided at the determined position. The base 2 is formed of a dielectric material having the determined dielectric constant.

For example, in the examples of the antenna structure 1 in the figures used to describe the first to fourth embodiments, the capacitance loading electrode 12 is formed at a corner of the base 2. However, by adjusting the dielectric constant of the base 2 as described above, for example, as shown in FIG. 11*a*, the capacitance loading electrode 12 can be formed at a position nearer to the center on a side surface of the base 2 in accordance with the determined position of the harmonic-mode zero voltage region P of the driven radiating electrode 6.

Although the entirety of the base 2 is formed of the same dielectric material in the example described above, the voltage distribution in the harmonic mode of the driven radiating electrode 6 is susceptible to the effect of the dielectric constant in a region where the open end of the driven radiating electrode 6 is formed. Thus, for example, it is possible to use a dielectric material having a dielectric constant for providing the harmonic-mode zero voltage region P of the driven radiating electrode 6 at the determined position to form only a base portion where the open end of the driven radiating electrode 6 is formed. Furthermore, for example, as shown in FIG. 11*b*, a dielectric member 30 having a dielectric constant for providing the harmonic-mode zero voltage region P of the driven radiating electrode 6 at the determined position may be provided in a base portion where the open end of the driven radiating electrode 6 is formed.

Figure 11A:
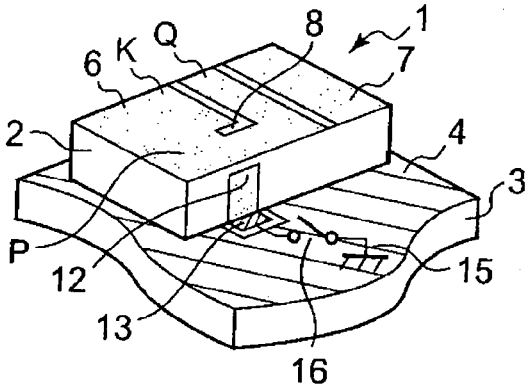
FIG. 11*a* is a model diagram showing an antenna structure having a configuration characteristic of a fifth embodiment.
Figure 11B:
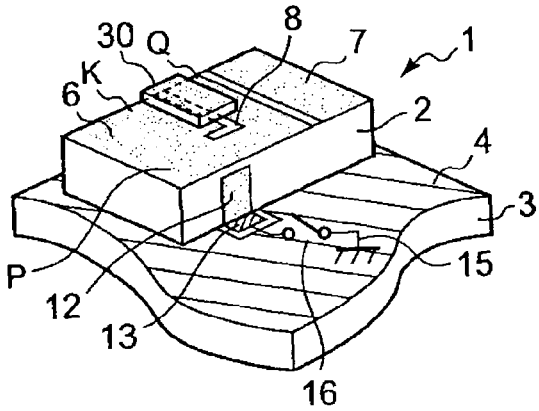
FIG. 11*b* is a model diagram showing another antenna structure having a configuration characteristic of the fifth embodiment.

Although the capacitance loading electrode 12 is provided as capacitance loading means on the side of the driven radiating electrode 6 in the examples shown in FIGS. 11*a* and 11*b*, capacitance loading means on the side of the driven radiating electrode 6 may have other configurations, such as those in the first to fourth embodiments described earlier. Furthermore, similarly to the fourth embodiment, parasitic-side capacitance loading means may be provided. For example, in a case where such parasitic-side capacitance loading means is provided and the position of forming the harmonic-mode zero-voltage region U is to be adjusted, similarly to the driven radiating electrode 6, it is possible to use a dielectric material having a dielectric constant for providing the harmonic-mode zero-voltage region U of the parasitic radiating electrode 7 at a determined position to form only a base portion where the open end of the parasitic radiating electrode 7 is formed. Alternatively, a dielectric member having a dielectric constant for providing the harmonic-mode zero-voltage region U of the parasitic radiating electrode 7 at a determined position may be provided in a base portion where the open end of the parasitic radiating electrode 7 is formed.

In the fifth embodiment, as described above, the dielectric constant of the base 2 is adjusted entirely or partially, or a dielectric member is provided on a region where the open end of the driven radiating electrode 6 or the parasitic radiating electrode 7 is formed, thereby adjusting the position where the harmonic-mode zero voltage region P of the driven radiating electrode 6 or the harmonic-mode zero-voltage region U of the parasitic radiating electrode 7 is provided. Thus, even in a case where the position of forming capacitance loading means for the driven radiating electrode 6 or the parasitic radiating electrode 7 is restricted, it is possible to load a capacitance to the harmonic-mode zero voltage region P of the driven radiating electrode 6 or the harmonic-mode zero-voltage region U of the parasitic radiating electrode 7 by the capacitance loading means. Thus, it is possible to perform switching of the base resonant frequency bands of the driven radiating electrode 6 and the parasitic radiating electrode 7.

Sixth Embodiment

Now, a sixth embodiment will be described. In the description of the sixth embodiment, components that are the same as those in the first to fifth embodiments will be designated by the same numerals, and repeated description of the common components will be omitted.

Depending on the specification of a wireless communication apparatus in which the antenna structure 1 is included, the base resonant frequency band of the driven radiating electrode 6 satisfies conditions of a predetermined frequency band without switching the base resonant frequency of the driven radiating electrode 6. In such a case, since it is not needed to switch the base resonant frequency of the driven radiating electrode 6, it is possible to construct an antenna structure 1 including an antenna component according to one of the first to fifth embodiments and not including the switching means 16. Thus, an antenna structure 1 according to the sixth embodiment is configured as follows.

Figure 12A:
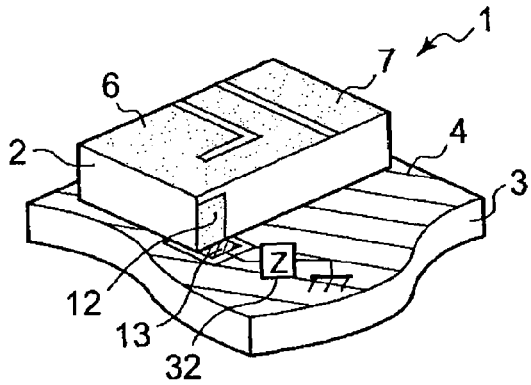
FIG. 12*a* is a model diagram showing an antenna structure having a configuration characteristic of a sixth embodiment.
Figure 12B:
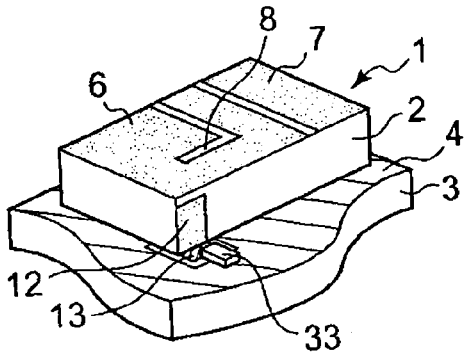
FIG. 12*b* is a model diagram showing another antenna structure having a configuration characteristic of the sixth embodiment.
Figure 12C:
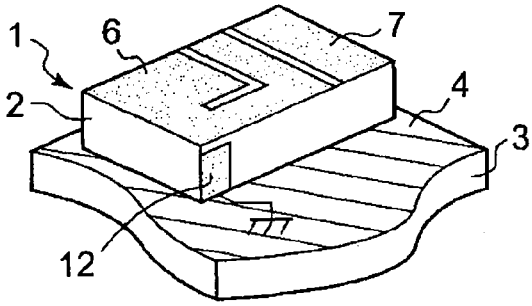
FIG. 12*c* is a model diagram showing yet another antenna structure having a configuration characteristic of the sixth embodiment.
Figure 13A:
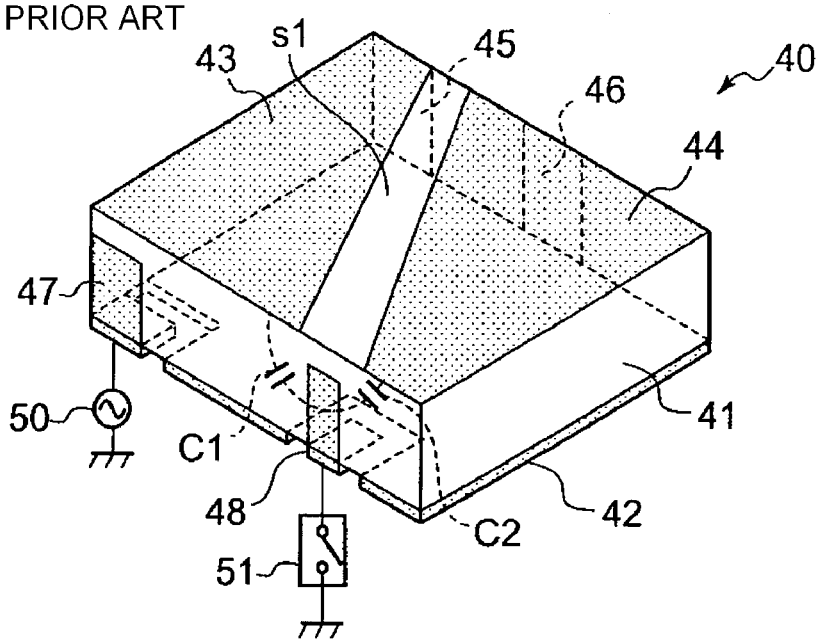
FIG. 13a PRIOR ART
FIG. 13*a* is a schematic perspective view showing a known antenna structure.
Figure 13B:
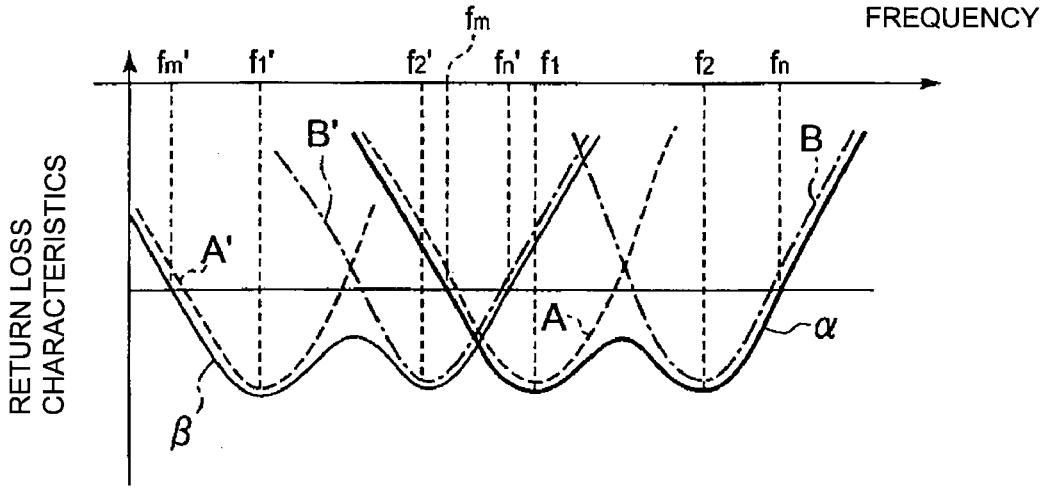
FIG. 13b PRIOR ART
FIG. 13*b* is a graph showing resonant frequency bands of the antenna structure.
Figure 13C:
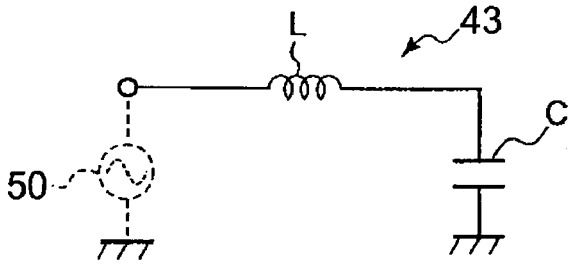
FIG. 13c PRIOR ART
FIG. 13*c* is a schematic diagram of an equivalent circuit.

In the sixth embodiment, as shown in FIGS. 12*a* to 12*c*, the capacitance loading electrode 12 provided on the base 2 is option capacitance loading means. For example, in a case where the antenna structure 1 with capacitance loading turned OFF has return loss characteristics indicated by the solid line α in FIG. 1*c* and the antenna structure 1 is required to support wireless communication in fourth frequency bands B, C, D, and E shown in FIG. 1*c*, it is not needed to turn on capacitance loading by the capacitance loading electrode 12 to cover the frequency band A. Thus, the capacitance loading electrode 12 may be fixed to an electrically open state. Thus, for example, as shown in FIG. 12*a*, instead of grounding the capacitance loading electrode 12 to the ground electrode 4, a load 32 having a predetermined impedance (desirably open) having a predetermined impedance when viewed from the capacitance loading electrode 12 toward the ground electrode 4 is connected to the capacitance loading electrode 12. Alternatively, for example, as shown in FIG. 12*b*, a load component having a predetermined impedance when viewed from the capacitance loading electrode 12 toward the ground electrode 4 is connected to the capacitance loading electrode 12.

Figure 1C:
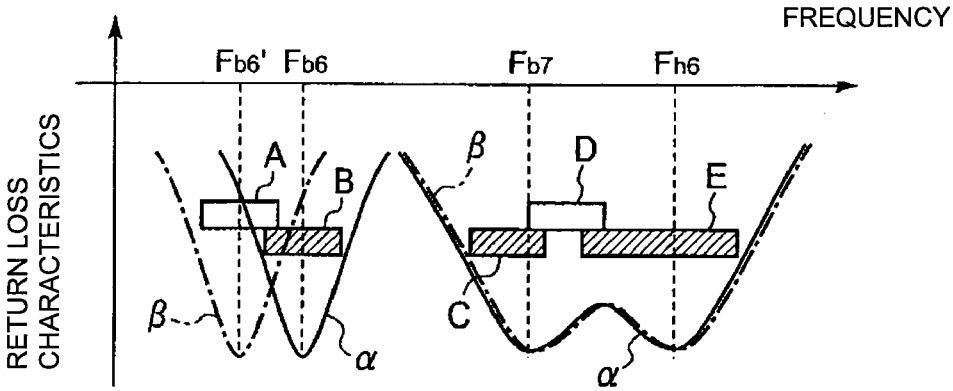
FIG. 1*c* is a graph for explaining an example of return loss characteristics of the antenna structure according to the first embodiment.

Furthermore, when the antenna structure 1 is required to support wireless communication in four frequency bands A, C, D, and E shown in FIG. 1*c*, it is not needed to cover the frequency band B by turning OFF capacitance loading by the capacitance loading electrode 12. Thus, the capacitance loading electrode 12 may be fixed to a shorted state. Thus, for example, the capacitance loading electrode 12 may be directly connected and grounded to the ground electrode 4 on the circuit board 3, as shown in FIG. 12*c*.

In the configuration of the antenna structure according to the sixth embodiment, since the switching means 16 can be omitted, it is possible to simplify the antenna structure. Instead of the capacitance loading electrode 12 shown in FIGS. 12*a* to 12*c*, as option capacitance loading means, for example, capacitance loading means having other configurations, for example, those shown in FIG. 7*a*, 7*b*, 7*d*, 7*e*, or 8*a*, may be provided. Furthermore, option capacitance loading means may be provided on the parasitic side.

In the sixth embodiment, option capacitance loading means is provided on the base 2. Thus, use of a common antenna component is allowed. That is, an antenna component in which option capacitance loading means is formed on the base 2 can be provided in an antenna structure 1 in which it is needed to load a capacitance with the ground electrode 4 to the harmonic-mode zero-voltage region P or U of the driven radiating electrode 6 or the parasitic radiating electrode 7, and also in an antenna structure 1 in which switching of the ON/OFF of capacitance loading is needed. Thus, use of a common antenna component is allowed, so that it is possible to reduce cost of the antenna structure 1.

Seventh Embodiment

Now, a seventh embodiment will be described. The seventh embodiment relates to a wireless communication apparatus. In the wireless communication apparatus according to the seventh embodiment, the antenna structure 1 according to one of the first to sixth embodiments is provided. The wireless communication apparatus except for the antenna structure can be configured in various manners, and the configuration of the wireless communication apparatus except for the antenna structure is not particularly limited and is determined as appropriate.

The present invention is not limited to the first to seventh embodiments, and various modified embodiments are possible. For example, although the driven radiating electrode 6 has such a form that the current path has a loop shape with the slit 8 in the first to seventh embodiments, for example, a driven radiating electrode 6 having a loop current path may be provided using strip electrodes. This also applies to a case where the parasitic radiating electrode 7 has a loop-shaped current path.

Furthermore, although the driven radiating electrode 6 has only one slit in the first to seventh embodiments, for example, a plurality of slits may be provided side by side, with the current path of the driven radiating electrode 6 having a loop shape extending around the slits to connect the feeding end Q and the open end K, and the number of slits formed is not limited. Furthermore, the shape of the slits is not limited. This also applies when slits are formed on the parasitic radiating electrode 7.

Furthermore, although the base 2 has a rectangular parallelepiped shape in the first to seventh embodiments, the base 2 may have shapes other than a rectangular parallelepiped shape, such as a cylindrical shape or a polygonal shape.

Furthermore, although one driven radiating electrode 6 and one parasitic radiating electrode 7 are provided on the base 2, a plural number of at least one of the driven radiating electrode 6 and the parasitic radiating electrode 7 may be provided on the base 2.

The present invention is suitable, for example, for an antenna structure that is compatible with a plurality of wireless communication systems having mutually different operating frequency bands and to a wireless communication apparatus.

Although particular embodiments have been described, many other variations and modifications and other uses will become apparent to those skilled in the art. Therefore, the present invention is not limited by the specific disclosure herein.

What is claimed is:

1. An antenna structure comprising:

a circuit board, a base mounted in a ground region of said circuit board, the base having provided thereon a driven radiating electrode that is electrically connected to a wireless communication circuit and that performs antenna operations in a plurality of resonant frequency bands different from each other, and a parasitic radiating electrode electromagnetically coupled to the driven radiating electrode with a space between the parasitic radiating electrode and the driven radiating electrode;

the driven radiating electrode being a radiating electrode having one end that serves as a feeding end electrically connected to the wireless communication circuit and the other end that serves as an open end, the driven radiating electrode having such a form that the feeding end and the open end thereof are provided adjacent to each other with a space therebetween so that a loop-shaped current path is formed between the feeding end and the open end;

the parasitic radiating electrode performing an antenna operation with the driven radiating electrode through electromagnetic coupling with the driven radiating electrode so as to cause multiple resonance at least in a harmonic resonant frequency band, the harmonic resonant frequency band being higher than a base resonant frequency band, the base resonant frequency band being lowest among the plurality of resonant frequency bands of the driven radiating electrode, the antenna structure further comprising:

capacitance loading means for loading a capacitance to a harmonic-mode zero-voltage region of the driven radiating electrode, the harmonic-mode zero-voltage region being a region where a voltage becomes zero or nearly zero in a harmonic mode, the harmonic mode being an antenna operation mode in the harmonic resonant frequency band;

a grounding conduction path that electrically connects a ground electrode with the capacitance loading means, the ground electrode being formed in the ground region on the circuit board; and switching means, provided in the grounding conduction path, for switching conduction ON/OFF between the capacitance loading means and the ground electrode on the circuit board to control switching between ON and OFF of capacitance loading by the capacitance loading means to the harmonic-mode zero-voltage region of the driven radiating electrode, thereby switching a base resonant frequency in the base resonant frequency band of the driven radiating electrode.

2. The antenna structure according to claim 1, wherein the driven radiating electrode has a slit formed therein so as to cut into the electrode from an end edge thereof such that, at the electrode end edge on the side of opening of cutting of the slit, with the slit in the middle, one end of the electrode serves as a feeding end and the other end serves as an open end, a current path between the feeding end and the open end of the driven radiating electrode has a loop shape extending around the slit and connecting the feeding end and the open end, wherein a region of turnback of the current path extending around the slit serves as the harmonic-mode zero-voltage region of the driven radiating electrode, and the capacitance loading means loads a capacitance to the region of turnback of the current path.

3. The antenna structure according to claim 1, wherein the parasitic radiating electrode is a radiating electrode that performs antenna operations in a plurality of resonant frequency bands different from each other, wherein an antenna operation in a base resonant frequency band, the base resonant frequency band being lowest among a plurality of resonant frequency bands of the parasitic radiating electrode, causes multiple resonance together with an antenna operation in the base resonant frequency band of the driven radiating electrode, and wherein an antenna operation in a harmonic resonant frequency band of the parasitic radiating electrode, the harmonic resonant frequency band being higher than the base resonant frequency band, causes multiple resonance together with an antenna operation in the harmonic resonant frequency band of the driven radiating electrode.

4. The antenna structure according to claim 3, wherein the parasitic radiating electrode includes one end that serves as a shorted end grounded to the ground electrode on the circuit board and the other end that serves as an open end, and the parasitic radiating electrode has such a form that the shorted end and the open end thereof are provided adjacent to each other with a space therebetween and a current path between the shorted end and the open end has a loop shape.

5. The antenna structure according to claim 3, comprising:

parasitic-side capacitance loading means for loading a capacitance to a harmonic-mode zero-voltage region of the parasitic radiating electrode, the harmonic-mode zero-voltage region being a region where a voltage becomes zero or nearly zero in a harmonic mode, the harmonic mode being an antenna operation mode in the harmonic resonant frequency band;

a parasitic-side grounding conduction path that electrically connects the parasitic-side capacitance loading means with the ground electrode on the circuit board; and switching means, provided in the parasitic-side grounding conduction path, for switching conduction ON/OFF between the parasitic-side capacitance loading means and the ground electrode on the circuit board to control switching between ON and OFF of capacitance loading by the parasitic-side capacitance loading means to the harmonic-mode zero-voltage region of the parasitic radiating electrode, thereby switching a base resonant frequency in the base resonant frequency band of the parasitic radiating electrode.

6. The antenna structure wherein the capacitance loading means in anyone of claims 1 to 5 is formed of a capacitance loading electrode for forming a capacitor with the harmonic-mode zero-voltage region of the driven radiating electrode or the parasitic radiating electrode or a capacitance loading capacitor component.

7. The antenna structure wherein the capacitance loading means in anyone of claims 1 to 5 is formed of a capacitance loading capacitor component, and the capacitance loading capacitor component is a variable-capacitance capacitor component that allows variable adjustment of a capacitance that is loaded to the harmonic-mode zero-voltage region of the driven radiating electrode or the parasitic radiating electrode.

8. The antenna structure wherein the capacitance loading means in anyone of claims 1 to 5 is formed of a capacitance loading electrode for forming a capacitor with the harmonic-mode zero-voltage region of the driven radiating electrode or the parasitic radiating electrode, and at least part of the capacitance loading electrode is buried inside the base.

9. The antenna structure wherein a plurality of the capacitance loading means in any one of claims 1 to 5 are provided on the base, these capacitance loading means serve to load mutually different capacitances to the harmonic-mode zero-voltage region of the driven radiating electrode or the parasitic radiating electrode, and one of the capacitance loading means or one of the parasitic-side capacitance loading means is electrically connected to the ground electrode on the circuit board by the grounding conduction path via the switching means.

10. The antenna structure wherein a plurality of the capacitance loading means in anyone of claims 1 to 5 are provided on the base, and the capacitance loading means are electrically connected individually to the ground electrode on the circuit board by the grounding conduction path via individually associated switching means.

11. The antenna structure according to anyone of claims 1 to 5, wherein the base is formed at least in part of a dielectric material having such a dielectric constant that a position of the harmonic-mode zero-voltage region is adjusted to a predetermined position.

12. The antenna structure according to anyone of claims 1 to 5, wherein a base portion where the open end of the driven radiating electrode is formed is formed at least in part of dielectric material having such a dielectric constant that a position of the harmonic-mode zero-voltage region of the driven radiating electrode becomes a predetermined base position.

13. The antenna structure according to anyone of claims 1 to 5, wherein, in a base portion where the open end of the driven radiating electrode is formed, a dielectric member having such a dielectric constant that a position of the harmonic-mode zero-voltage region of the driven radiating electrode becomes a predetermined position is provided.

14. The antenna structure wherein the parasitic-side capacitance loading means in claim 5 is formed of a capacitance loading electrode for forming a capacitor with the harmonic-mode zero-voltage region of the driven radiating electrode or the parasitic radiating electrode or a capacitance loading capacitor component.

15. The antenna structure wherein the parasitic-side capacitance loading means in claim 5 is formed of a capacitance loading capacitor component, and the capacitance loading capacitor component is a variable-capacitance capacitor component that allows variable adjustment of a capacitance that is loaded to the harmonic-mode zero-voltage region of the driven radiating electrode or the parasitic radiating electrode.

16. The antenna structure wherein the parasitic-side capacitance loading means in claim 5 is formed of a capacitance loading electrode for forming a capacitor with the harmonic-mode zero-voltage region of the driven radiating electrode or the parasitic radiating electrode, and at least part of the capacitance loading electrode is buried inside the base.

17. The antenna structure wherein a plurality of the parasitic-side capacitance loading means in claim 5 are provided on the base, these capacitance loading means serve to load mutually different capacitances to the harmonic-mode zero-voltage region of the driven radiating electrode or the parasitic radiating electrode, and one of the capacitance loading means or one of the parasitic-side capacitance loading means is electrically connected to the ground electrode on the circuit board by the grounding conduction path via the switching means.

18. The antenna structure wherein a plurality of the parasitic-side capacitance loading means in claim 5 are provided on the base, and the capacitance loading means are electrically connected individually to the ground electrode on the circuit board by the grounding conduction path via individually associated switching means.

19. An antenna structure comprising:

a circuit board, a base mounted in a ground region of said circuit board, the base having provided thereon a driven radiating electrode that is electrically connected to a wireless communication circuit and that performs antenna operations in a plurality of resonant frequency bands different from each other, and a parasitic radiating electrode electromagnetically coupled to the driven radiating electrode with a space between the parasitic radiating electrode and the driven radiating electrode;

the driven radiating electrode being a radiating electrode having one end that serves as a feeding end electrically connected to a wireless communication circuit and the other end that serves as an open end, the driven radiating electrode having such a form that the feeding end and the open end thereof are provided adjacent to each other with a space therebetween so that a loop-shaped current path is formed between the feeding end and the open end;

the parasitic radiating electrode performing an antenna operation with the driven radiating electrode through electromagnetic coupling with the driven radiating electrode so as to cause multiple resonance at least in a harmonic resonant frequency band, the harmonic resonant frequency band being higher than a base resonant frequency band, the base resonant frequency band being lowest among the plurality of resonant frequency bands of the driven radiating electrode, the antenna structure further comprising:

option capacitance loading means for loading a capacitance to a harmonic-mode zero-voltage region of the driven radiating electrode, formed on the base, the harmonic-mode zero-voltage region being a region where a voltage becomes zero or nearly zero in a harmonic mode, the harmonic mode being an antenna operation mode in the harmonic resonant frequency band, wherein when the option capacitance loading means loads a capacitance to the harmonic-mode zero-voltage region of the driven radiating electrode, a grounding conduction path is formed with a ground electrode formed in the ground region on the circuit board so that a capacitance is loaded to the harmonic-mode zero-voltage region of the driven radiating electrode, and when the option capacitance loading means does not load a capacitance to the harmonic-,mode zero-voltage region of the driven radiating electrode, a grounding conduction path is not formed.

20. A wireless communication apparatus comprising:

the antenna structure according to anyone of claims 1 to 5 or claim 19; and a wireless communication circuit electrically connected to said driven radiating electrode.

* * * * *